US006407732B1

(12) United States Patent
Stiens et al.

(10) Patent No.: US 6,407,732 B1
(45) Date of Patent: Jun. 18, 2002

(54) LOW POWER DRIVERS FOR LIQUID CRYSTAL DISPLAY TECHNOLOGIES

(75) Inventors: Johan Stiens, Brussels; Maarten Kuijk, Berchem-Antwerpen, both of (BE)

(73) Assignee: Rose Research, L.L.C., Dallas., TX (US)

( * ) Notice: Subject to any disclaimer, the term of this patent is extended or adjusted under 35 U.S.C. 154(b) by 0 days.

(21) Appl. No.: 09/217,122

(22) Filed: Dec. 21, 1998

(51) Int. Cl.[7] ..... G09G 5/100

(52) U.S. Cl. ..... 345/204; 345/87; 345/90; 345/98; 345/100; 345/211; 345/212; 345/213; 345/99

(58) Field of Search ..... 345/204, 211, 345/212, 213, 87, 90, 100, 98, 95, 99

(56) References Cited

U.S. PATENT DOCUMENTS

| | | | | |
|---|---|---|---|---|
| 4,291,240 A | | 9/1981 | Rosler | 307/262 |
| 4,370,570 A | | 1/1983 | Dash et al. | 307/270 |
| 4,613,771 A | | 9/1986 | Gal | 307/443 |
| 5,438,290 A | | 8/1995 | Tanaka | |
| 5,717,437 A | | 2/1998 | Sano et al. | 345/211 |
| 5,731,722 A | | 3/1998 | Sugiki et al. | |
| 5,744,943 A | | 4/1998 | Tokai | 323/282 |
| 5,754,011 A | | 5/1998 | Frus et al. | 315/209 |
| 5,808,420 A | | 9/1998 | Rilly et al. | 315/169.4 |
| 5,828,357 A | | 10/1998 | Tamai et al. | 345/89 |
| 5,883,505 A | | 3/1999 | Magazzu et al. | 323/282 |
| 5,929,620 A | | 7/1999 | Dobkin et al. | 323/288 |
| 5,943,030 A | | 8/1999 | Minamibayashi | 345/60 |
| 6,201,420 B1 | * | 3/2000 | Harvey | 327/109 |
| 6,049,321 A | * | 4/2000 | Sasaki | 345/99 |
| 6,107,981 A | * | 4/2000 | Fujita | 345/95 |
| 6,069,605 A | * | 5/2000 | Ozawa | 345/98 |
| 6,108,000 A | * | 8/2000 | Bolotski et al. | 345/212 |
| 6,140,848 A | * | 10/2000 | Harvey | 327/112 |
| 6,211,701 B1 | * | 4/2001 | Kuijk et al. | 326/83 |

FOREIGN PATENT DOCUMENTS

| | | | |
|---|---|---|---|
| EP | 0 395 146 A1 | 10/1990 | |
| EP | 0 680 148 A2 | 11/1995 | |
| FR | 2 741 741 A1 | 11/1996 | G90G/3/28 |
| GB | 2317736 A | 4/1998 | G09G/3/28 |
| JP | 62/029312 | 2/1987 | |
| JP | 09258170 | 10/1997 | G02F/1/133 |
| WO | 97/09783 | 3/1997 | |

OTHER PUBLICATIONS

Seitz et al., "Hot Clock nMOS", 1985 Chapel Hill Conference on VLSI, pp. 1–17.

Yamauchi et al., "An Asymptotically Zero Power Charge–Recycling Bus Architecture for Battery–Operated Ultra-high Data Rate ULSI's", IEEE Journal of Solid State Circuits, Apr. 1995, pp. 423–431.

(List continued on next page.)

*Primary Examiner*—Richard Hjerpe
*Assistant Examiner*—Ali Zamani
(74) *Attorney, Agent, or Firm*—Slater & Matsil, LLP

(57) ABSTRACT

A driver circuit can be used to drive a matrix display device, such as a liquid crystal display, that includes a plurality of pixels 16 disposed in rows 12 and columns 14. A first switch 328 has a current path coupled between a high voltage node (e.g., $V_S$) and a group of pixels 16. As an example, the group of pixels 16 can be a row 12 or a column 14. A second switch 326 has a current path coupled between a low voltage node (e.g., ground) the group of pixels 16. A third switch 322 has a current path coupled between an inductive storage element 34 and the group of pixels. The inductive storage element 34 is coupled to an intermediate voltage node (e.g., $V_{S/2}$) with a voltage between the voltage at the high voltage node and the voltage at the low voltage node.

54 Claims, 13 Drawing Sheets

OTHER PUBLICATIONS

Hiraki et al., "Data–Dependent Logic Swing Internal Bus Architecture for Ultralow–Power LSI's," IEEE Journal of Solid State Circuits, Apr. 1995, pp. __.

Kushiyama et al., "A 500 Megabyte/s Data–Rate 4.5M DRAM", IEEE Journal of Solid State Circuits, Apr. 1993, pp.__.

"A 23–cm–Diagonal Bright Reflective Guest–Host TFT–LCD"; H. Kanoh, et al.; SID 95 Digest; 1995; p. 333–36.

"Multi–Field Driving Method for Reducing LCD Power Consumption"; H. Okumura, G. Itoh; SID 95 Digest; 1995; p. 249–52.

"Invited Paper: Two–Terminal Devices Technologies for AMLCDs"; R. A. Hartman; SID 95 Digest; 1995; p. 7–10.

"Circuit Design for a–Si AMLCDs with Integrated Drivers"; R. G. Stewart, et al.; SID 95 Digest; 1995; p. 89–92.

"Inverse Staggered Poly–Si and Amorphous Si Double Structure TFT's for LCD Panels with Peripheral Driver Circuits Integration"; T. Aoyama, et al.; IEEE Transactions on Electron Devices, vol. 43, No. 5; May 1996; p. 701–05.

"Half–Column–Line Driving Method for Low–Power and Low–Cost TFT–LCDs"; M. Sakamoto, et al.; SID 97 Digest; 1997; p. 387–90.

"Late–News Paper: Charge–Conservation Implementation in an Ultra–Low–Power AMLCD Column Driver Utilizing Pixel Inversion"; A. Erhart, D. McCartney; SID 97 Digest; 1997; p. 23–6.

"Scanning Limitation of Liquid–Crystal Displays"; P. Alt, et al.; IEEE Transactions on Electron Devices: vol. ED–21, No. 2; Feb. 1974; p. 146–55.

* cited by examiner

DATA CONTROLLER
CLK
DATA SELECT
ROW CONTROLLER
CLK
ROW SELECT
SWITCH SELECT
OSCILLATION SENSING CIRCUITRY
LC
OR
Vlc
Vst
Vd
-Vd
Vs
-Vs
Vs/2
-Vs/2
Ca,1
Ca,2
Cb,1
Cb,2
SLa
SLb
L
r1
r2
ri
rn
d1
d2
dj
dm
10
12
12'
14
16
18
20
34
36a
36b
38a
38b
40
42
46
48
50
162
164
166
322
324
326
328

LOW POWER DRIVERS FOR LIQUID CRYSTAL DISPLAY TECHNOLOGIES

CROSS-REFERENCE TO RELATED APPLICATIONS

The following U.S. patents and/or commonly assigned patent applications are hereby incorporated herein by reference:

| Patent or Serial No. | Filing Date | Issue Date | Attorney Docket No. |
|---|---|---|---|
| 08/767,193 | 12/16/96 | | Rose-8001 |
| 09/111,532 | 07/08/98 | | Rose-8004 |

FIELD OF THE INVENTION

This invention relates generally to drive circuits and specifically to low power drivers for liquid crystal display technologies.

BACKGROUND OF THE INVENTION

The demand for Liquid Crystal Displays (LCD) continues to exceed supply. LCD's are implemented as screens on almost all types of digital devices, including watches, personal computers, video monitors, portable computers (e.g., laptops, notebooks, handheld, palm) and projection displays. The size of the display area has steadily grown while general performance of LCD's has steadily improved in the last years. But an important issue is the power dissipation of the growing LCD's.

Users are steadily looking for increased display size and higher resolution. Enhancing both of these features, however, consumes more and more energy. New designs for portable digital devices, in particular, are aiming at lowering the power dissipation of every component and therefore increasing battery life.

Among the different factors contributing to the power dissipation of an LCD are the background illumination and the signal or image information transfer. The background illumination can be completely eliminated in applications where the natural incident light can be used so that the LCD operates in a reflection mode. In one aspect, this invention relates to the power reduction related to the signal or image information. This signal information transfer is related to the charging and discharging of a matrix of capacitive LC-pixels.

The most popular and most widely used LCD's are based on Twisted Nematic, Super Twisted Nematics and Cholesterics. Displays fabricated with these kinds of LCD-materials operate with polarizers and analyzers, hence restricting the use of back light free operation. This induces optical losses such that more power is needed for the back light illumination or higher levels of natural incident light are required.

More recently much effort has been spent in the development of Polymer Dispersed LCD's as described by Ikeno et al., "A 23-cm Diagonal Bright Reflective Guest-Host TFT-LCD", SID 1995 Digest, pp. 333–336. These Polymer Dispersed LCD's do not use polarizers, thereby saving back light power or allowing a lower level of natural light illumination. Unfortunately, the driving voltages for the Polymer Dispersed LCD pixels are higher and therefore any energy saved from lower power back light illumination is lost. The present invention can drastically lower the power dissipated when driving the pixels even at extended voltage levels, such that eventually the LCD consumes less energy.

Several methods, or addressing schemes, have been developed for sending signals or image information to LCD's. The three most important are : direct addressing, and passive and active matrix addressing. Direct addressing, usually used in watches and calculators, is great for simple alphanumeric characters, since one signal controls one segment of pixels. However, direct addressing is unrealistic for larger systems because of the large number of wires that need to be interfaced.

In a matrix system, the number of wires can be greatly reduced by splitting up the display into a grid of wires called rows and columns, with a pixel at the intersection of each row and column. Matrix displays can be grouped into two categories, passive matrix liquid crystal displays (PMLCD) and active matrix liquid crystal displays (AMLCD).

A PMLCD is the simplest display for achieving low power, low cost and small size. In a PMLCD, only a LC-pixel is located at the intersection of each column and row. PMLCD's have, in general, less performance than the AMLCD's but are much simpler to fabricate and therefore preferred for smaller, less accurate displays. In an AMLCD, an extra nonlinear element is introduced at each pixel location to enhance the nonlinear behavior (i.e., contrast) of each pixel. This extra nonlinear element can be a two-terminal device or a three-terminal device. The number of terminals at the pixel location influences the driving scheme.

The trend toward larger, higher definition displays in notebook computers is forcing display manufacturers to seek new electrical drive methods for the integrated circuit that drives the LCD. Current methods for driving the electrical signals onto these displays have been proposed to address significant issues with power dissipation and image quality.

For example, Erhart et al. ("Charge-Conservation Implementation in an Ultra-Low-Power AMLCD Column Driver Utilizing Pixel Inversion", SID 1997 Digest, pp. 23–26) implemented a capacitively based energy recovery method for AMLCD displays. At the beginning of each row time, the column busses are shorted together to a supplemental capacitor, which naturally maintains a potential halfway between average upper and average lower voltage. The maximum power saving of this method is limited to 50%.

Okumura et al. ("Multifield driving method for reducing LCD Power dissipation", SID 1995 Digest, pp. 249–252) proposed a multi-field driving method for reducing LCD power dissipation. In this method, the image refresh rate is lowered without flicker occurrence by dividing the field image into an odd number of interlaced sub-field images. One sub-field flicker is compensated by the other sub-field flickered images. The power reduction is here limited to 30%.

In another proposal formulated by Sakamoto et al. ("Half-Column-Line driver method for Low-Power and Low-Cost TFT-LCDs", SID 1997 Digest, pp. 387–390), the number of column drivers is halved and the number of row drivers doubled. This technique can lead again to a power reduction of 50%.

The driving power of the LCD's schemes for two terminal devices has been improved by increasing the number of voltage levels applied to the select line as outlined by R. A. Hartman ("Two-Terminal Devices Technologies for AMLCDs", SID 1995 Digest, pp. 7–9). The excellent image quality demands higher power dissipation. The system of the present invention is compatible with these improved schemes but further reduces the power dissipation.

In some cases, panel manufacturers are returning to direct drive displays. Direct drive refers to the ability of the column driver chips to "directly" provide the alternating voltage and the variable magnitude. See, for example, Erhart et al. ("Charge-Conservation Implementation in an Ultra-Low-Power AMLCD Column Driver Utilizing Pixel Inversion", SID 1997 Digest, pp. 23–26). This early drive technique had been abandoned by many of the major LCD manufacturers due to cost concerns and replaced by common backplane node driving. :Although direct drive requires higher voltage driver circuits, substantial power dissipation and image quality improvement could be reached compared to traditional drive methods. The complementary driving schemes, direct drive and common backplane node, can both benefit from the driving circuit and method described herein. But even the prior art methods proposed to date have not provided satisfactory reduction of power dissipation.

The cost of the LCD is partially influenced by the glass quality and the integration possibility of the peripheral driver circuits on the LCD substrate. This is discussed by Stewart et al., "Circuit Design for a-silicon AMLCDs with Integrated Drivers", SID 1995 Digest, pp. 89–92 and Aoyama et al., "Inverse Staggered poly-Si and Amorphous Si Double Structure Thin Film Transistors and LCD Panels with Peripheral Driver Circuits Integration", IEEE Trans. Elect. Devices 43(5), pp. 701–705 (1996). Drivers and nonlinear elements integrated on poly-Si substrates feature low resistances but also require expensive high-quality glass resistant to high temperature processing. The technological tendency has been toward laser annealed hydrogenated amorphous silicon (a-Si:H), which features low resistance values and process temperatures and therefore cheaper glass. The invention proposed here can strongly benefit from these technological improvements as explained below.

SUMMARY OF THE INVENTION

In one aspect, the present invention proposes a driving system where the pixels of a LCD or similar device are charged and discharged by constructing a LRC resonant circuit whose oscillation can be interrupted after half an oscillation period (or after an even number of full periods). The energy used for charging a pixel is partially recuperated when discharging the pixels. The energy recuperation improves with the decrease of the resistance of the drivers and the nonlinear elements in the AMLCD's. The proposed driving circuit and methods of this embodiment will continue to benefit from these technological tendencies.

In another aspect, the present invention is directed toward a novel apparatus and method for charging and discharging the pixels of a matrix-based liquid crystal display. The power dissipation is reduced without sacrificing the quality of operation of the liquid crystal display matrix.

The present invention also provides an oscillation sensing means and a method to sense the state of the oscillation such that the oscillation can be interrupted at the appropriate time.

In one aspect, a row driver circuit can be used with a matrix display device that includes a plurality of pixels disposed in rows and columns. The row driver circuit includes at each row a first and second switch with their current path coupled to a positive and negative high voltage node, respectively. A third switch at each row is coupled with its current path to the ground. A fourth switch at each row enables or disables the oscillation of the resonant row circuit, comprising a common inductive element connected to common switches. A first common switch couples the common inductive element to half the positive high voltage node. A second switch couples the inductive element to half the negative high voltage node. Variants on this scheme will be detailed later.

In another aspect, a column driver circuit can be used with a matrix display device that includes a plurality of pixels disposed in rows and columns. The column driver circuit includes at each column a first and second switch with their current path coupled to a positive and negative high voltage node, respectively. A third switch at each column connects or disconnects the said. column to a common resonant circuit, consisting of a common inductive element connected at one side to ground and at the other side to the common node of the said third switches. A matrix display can use either one or both of these column driver circuits and row driver circuits.

Depending on the matrix technology used, the novel driving methodology can be adapted. In the preferred embodiment, different driving schemes are proposed for passive matrix (PMLCD), two-terminal active matrix, and three terminal active matrix (AMLCD). Examples of these embodiments are described in the next paragraphs.

Columns/Passive Matrix and Three Terminal Active Matrix. In this embodiment, the driving scheme allows a subset of columns of pixels to be connected together thereby reversing their polarity from plus to minus in a first step and from minus to plus in a second step. In this embodiment, the polarity change for each group of pixels is established in a sequential way, by connecting them to an inductive element whose voltage node is biased at a voltage level between the opposite polarity voltage levels. Energy stored in a capacitive form on one such group of connected columns is transferred to the inductive energy storage element and then back towards the capacitive pixels. Snap circuits can be employed to snap the voltage to the required voltage level after the non-perfect voltage change occurs.

Rows/Passive Matrix, Two-Terminal and Three-Terminal Active Matrix. In this embodiment, the driving scheme allows the pixels (or the gates) of each row to charge in turn from the deselecting voltage level toward the selecting voltage level via an inductive storage element whose voltage node is biased at a mid-level voltage. When the capacitive energy is transferred from the pixels (or the gates) toward the inductive element and back, all the pixels (or the gates) of one row are snapped to the selecting voltage level during the select time interval. Afterwards all the pixels (or the gates) are discharged again to the deselecting voltage level by means of the same inductive storage element connected to the same voltage node. When the capacitive energy is again transferred from the pixels (or the gates) of one such row toward the inductive element and back, all the pixels (or the gates) of this one row are snapped to the deselecting voltage level during a frame time period. After one row time, the next row of pixels is treated similarly. This cycle repeats each frame time.

Rows/Passive Matrix and Two-Terminal Active Matrix. In another embodiment for this example, the driving scheme allows a voltage pulse to be sent to each row of pixels in turn. Each row is first charged from the deselecting voltage level toward about $\sqrt{2}$ times the selecting voltage level and immediately back to the deselecting voltage level via an inductive storage element. Again, the inductive storage element is biased at a voltage level between the select and deselect voltage levels. Energy in a capacitive form on the connected row of pixels is transferred to the inductive energy storage element and back towards the capacitive row of pixels. The energy exchange from the capacitive form towards the inductive form and back is repeated an even number of times such that at the end of the select time interval the deselect voltage level is again acquired on the selected row of pixels. A snap circuit can be employed to snap the voltage to the required deselect voltage level after the voltage pulse is fed to one row of pixels. After one row time the next row of pixels is treated similarly. This cycle repeats each frame time.

Rows/Passive Matrix and Two-Terminal Active Matrix. In another embodiment for this example, the inter-row transfer driving scheme allows the deselection and selection of two consecutive rows in a coupled way in turn. A first row is first discharged from the selecting voltage level ($\pm V_s$) toward the deselecting voltage level via an inductive storage element. In this case, the inductive storage element is biased at the deselecting voltage. Energy stored in a capacitive form on the connected row of pixels is transferred to the inductive energy storage element. At that moment when the first row reaches the deselecting voltage level, the next row of pixels is connected to the same side of the same inductive element while the first row of pixels is disconnected. This allows the inductive energy stored in the inductor to be transformed to capacitive energy of the second row of pixels. When the second row of pixels is charged up to the selecting voltage level ($\}V_s$) but reverse polarity with respect to the first row of pixels, the second row of pixels is also disconnected. A snap circuit can be employed to snap the voltage of both rows to the required deselect voltage. After one row time the next couple of rows of pixels is treated similarly. This cycle repeats each frame time. This embodiment implements the row inversion method in a natural way.

The preferred embodiment of the present invention also allows the voltage level of the common node of a three terminal active matrix liquid crystal display to change by connecting it to an inductive element biased at voltage level between the required voltage levels.

Various embodiments of the present invention also include oscillation-sensing circuitry (OSC). An oscillation sensing circuit is added to the different driver schemes to sense the state of the oscillation and to interrupt the oscillation at the appropriate time.

BRIEF DESCRIPTION OF THE DRAWINGS

The above features of the present invention will be more clearly understood from consideration of the following descriptions in connection with accompanying drawings in which.

DESCRIPTION OF ILLUSTRATIVE EMBODIMENTS

The making and use of the various embodiments are discussed below in detail. However, it should be appreciated that the present invention provides many applicable inventive concepts, which can be embodied in a wide variety of specific contexts. The specific embodiments discussed are merely illustrative of specific ways to make and use the invention, and do not limit the scope of the invention.

The present invention will now be described with reference to the drawings. After briefly discussing power dissipation in matrix displays, a first embodiment will be discussed with reference to a row driver of a general matrix LCD. Variations to the circuit will then be discussed. Peculiarities for three terminal AMLCDs will be highlighted. After discussing the row drivers of matrix LCDs, an explanation of how the invention could be used with column drivers of matrix LCDs will be provided. Finally a new circuitry for common plate driving for three-terminal AMLCDs will be proposed.

Figure 1:
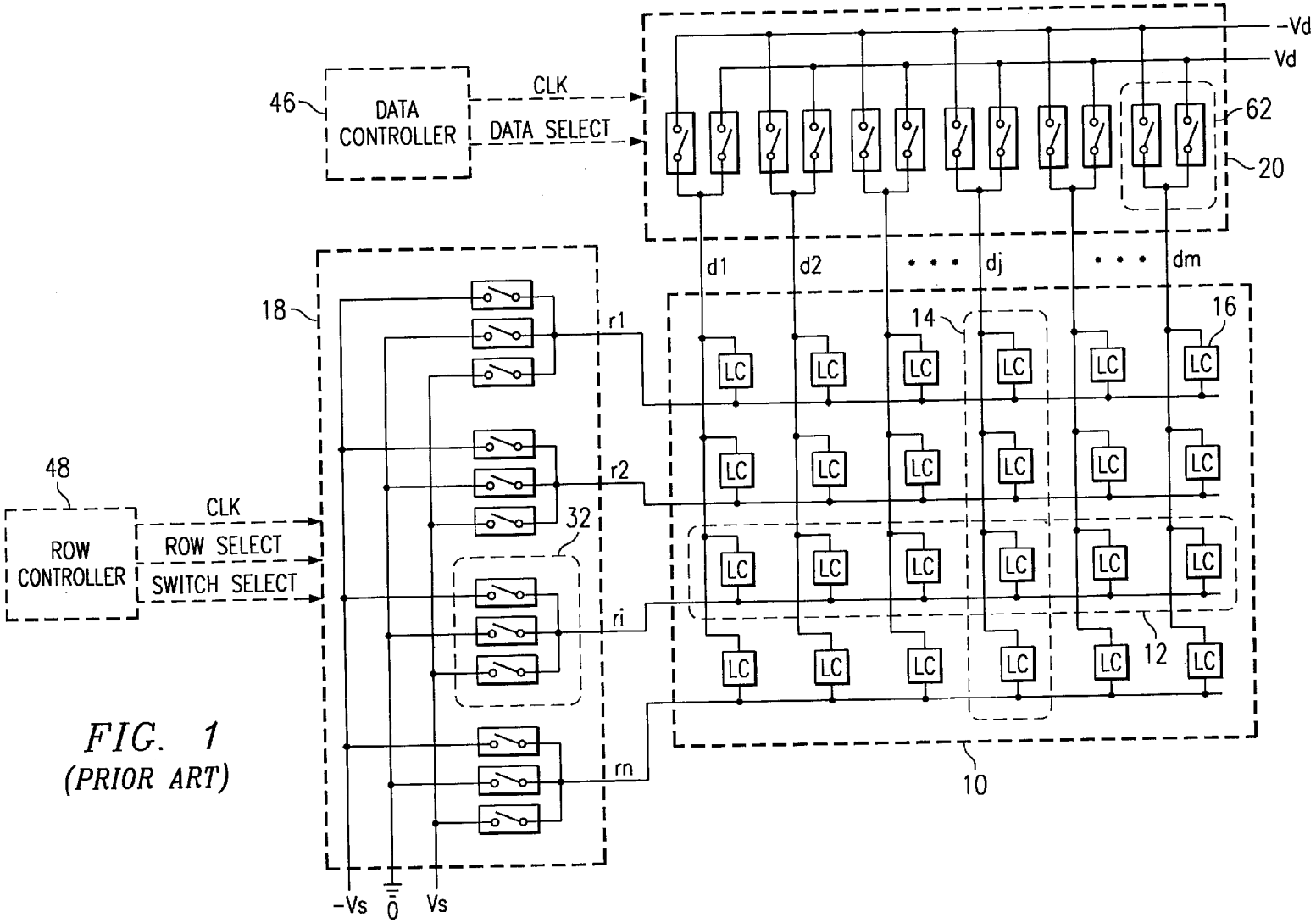
FIG. 1 (PRIOR ART)
FIG. 1 illustrates schematically the electrical equivalent scheme of a known general matrix Liquid Crystal Display.
Figure 2:
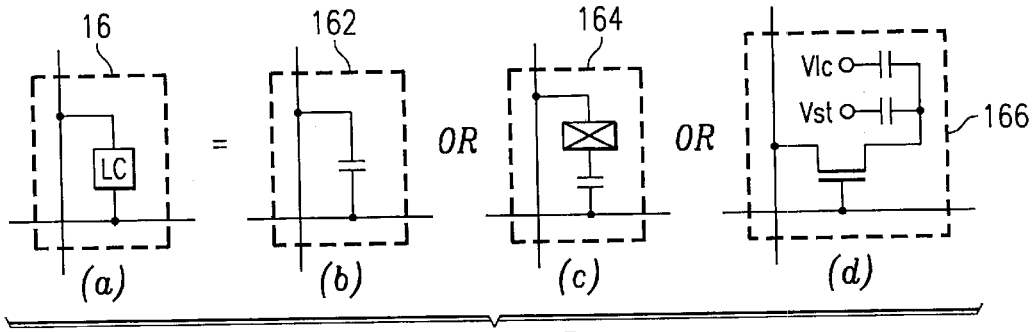
FIG. 2 zooms in on the three basic variants of a LCD-pixel: a passive, a two-and three-terminal active device.

A classic matrix display 10 is made up of both rows 12 and columns 14 as shown schematically in FIG. 1. The intersection of each row 12 and column 14 is the location of a Liquid Crystal (LC) cell 16, called a pixel 16. This general pixel presentation leads to different variations 162, 164 and 166 as shown in FIG. 2. a passive matrix liquid crystal display (PMLCD) such a LC-pixel 16 is generally made from an insulated material, which can be electronically represented in its simplest way by a capacitor 162 as shown in FIG. 2(*b*). An extra storage capacitor (not shown) can be added to the intersection points. In two-terminal active matrix liquid crystal display (AMLCD) an extra nonlinear element is added to the pixel 164 in order to intensify the contrast ratio of the LC pixel (FIG. 2*c*) and to introduce a memory like function. Parasitic capacitances of such nonlinear elements at the pixel position 16 can also be included in the equivalent capacitance value of the LC-pixel. In a third variant (FIG. 2*d*) the pixel 166 consists of the LC element together with a field effect transistor. Frequently the storage capacitor is added to the pixel location.

Returning to FIG. 1, pixels 16 on the same row 12 share the same select or row driver 32 of the driver set 18. Pixels 16 in the same column 14 share the same data or column driver 62 of the driver set 20. It is common usage that the transfer of the pixel data is accommodated through the use of a demultiplexer circuit (not shown) in order to limit the number of interconnections to the outside world. With this configuration, cross talk exists between the different pixels but is attenuated by the nonlinear response of the LC pixel 16. An extra nonlinear circuit element can be incorporated at each pixel 16 to suppress cross talk as done in active matrix addressing.

Figure 3:
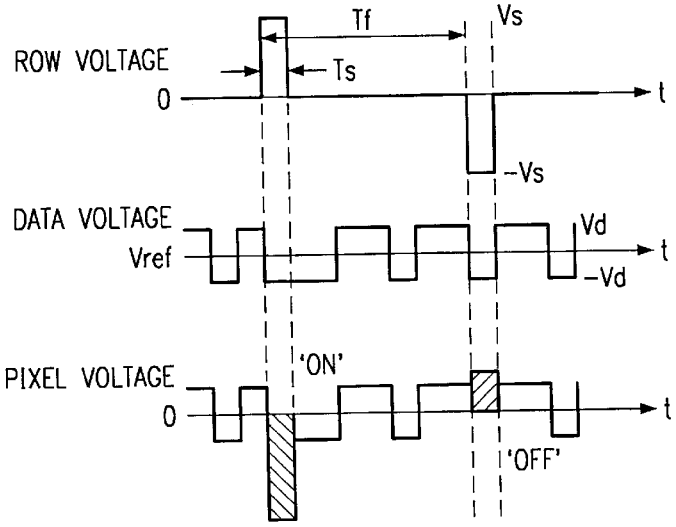
FIG. 3 is a timing diagram showing an example of the driving voltages for the row and data lines of a pixel.

FIG. 3 illustrates a timing diagram for operating a PMLCD 10 of FIG. 1.

This passive matrix-addressing scheme of mean-square responding LCD's is also discussed by Alt and Pleshko (P. M. Alt and P. Pleshko, Scanning limitations of liquid-crystal displays, IEEE Trans. Elec. Devices ED-21, p.146, 1974). A complete frame is written in a time $T_f$, by sequentially activating the select lines during a select time $T_s$ by means of the select voltage $V_s$. and simultaneously applying a voltage $V_d$ to the data lines. For black-white LCD's, $V_d$ is a binary signal. Grey scale LCD's, on the other hand, use e.g. multiple values for $V_d$.

The nonlinearity parameter P of a LC-pixel 16 is defined in terms of the RMS-voltages of the ON-state and OFF-state $V_1$ and $V_0$ respectively, relative to the optical threshold voltage $V_{th}$. The optical threshold voltage $V_{th}$ is the voltage level necessary to be applied to a pixel 16 in order for that pixel 16 to be illuminated. The nonlinearity parameter can be expressed as $$P=(V_1-V_0)/V_{th}$$

The P value determines the limit on the maximum number of addressable rows M For P<<1, the expressions simplify. In that case the relation between the number of addressable rows M and the corresponding data voltage $V_d$ and select voltage $V_s$ are deduced:

$$M = P^{-2}, \quad V_1 / V_0 = \sqrt{\frac{1+P}{1-P}}, \quad V_d / V_s = P$$

These equations illustrate that the data voltage $V_d$ is much smaller than the select voltage $V_s$. Since LCDs do not allow a DC voltage, the data and select voltages have both polarities $\pm V_d$ and $\pm V_s$. The time evolution of the voltages applied to prior art driver circuits of a PMLCD is shown in FIG. 3. The dynamic power dissipation of such a PMLCD can then be calculated $$P_{eli}(PMLCD)=V_d^2C_{pix}MN(Mf_{fr})+V_S^2C_{pix}N(Mf_{fr})$$

M and N are the number of rows and columns in the passive matrix, respectively. fit is the frame frequency, which is typically between about 50 and about 100 Hz.

By introducing the nonlinearity parameter P in this power dissipation equation we can compare the contribution from the rows and the columns.

$$P_{eli}(PMLCD)=V_s^2C_{pix}f_{fr}MN(MP^2+1)$$

If $P^{-2}$ defines the maximum numbers of rows for which a particular PMLCD would still be operational, then M can be defined as $M=\beta\cdot P^{-2}$ with $\beta<1$. This leads to the following dissipation formula $$P_{eli}(PMLCD)=V_s^2C_{pix}f_{fr}MN(\beta+1)$$

The parameter β defines the distribution of the power dissipation between the rows and the columns and provides an indication of where the proposed invention can best be used, in the column or row driver or both.

The power dissipation in a 2-terminal AMLCD will now be discussed. The nonlinear two terminal device is designed such that cross talk between pixels of different rows is strongly reduced. Hence one can calculate that the power reduces to the following expression:

$$P_{eli}(2T\text{–}AMLCD)=V_d^2C_{pix}\cdot N(Mf_{fr})+V_s^2C_{pix}N(Mf_{fr})$$

This equation shows that the contribution of the columns to the total power dissipation decreases approximately with a factor M with respect to the PMLCD. As a consequence, power reduction for the row driving is here important. When the row voltage is low, the nonlinear element is quasi nonconductive, irrespective of the column voltage. The column voltage has a value equal to or smaller than the threshold voltage of the nonlinear element. In the nonconductive state, loading data by means of an inductor is usually futile because the $V_{lost}$ would be intolerably high. Hence in a two terminal AMLCD it is preferably to drive only the rows adiabatically or by means of an LRC-circuit.

The next type of display for which the power dissipation is discussed is the 3-terminal AMLCD. In this case the nonlinear element added to the LC-pixel is a thin Film Transistor as illustrated in FIG. 2*d*. The row signals are now applied to the gates of all the transistors of one row at a time. The power dissipation reads as $$P_{eli}(3T\text{–}AMLCD)=V_d^2C_{pix}\cdot N(Mf_{fr})+V_s^2C_gN(Mf_{fr})$$

As the gate capacitances $C_g$ are typically smaller than the pixel capacitances $C_{pix}$, and the driver voltage for the gates is of the same order as that of columns, it is clear that the row contribution to the power dissipation again is smaller than the column contribution.

Figure 4:
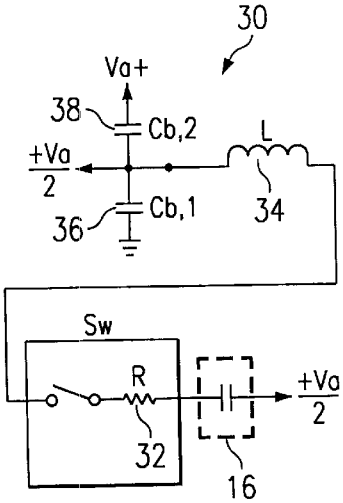
FIG. 4 shows the basic circuit building block of the invention.

In order to appreciate the operation principles proposed in this invention for driving LCD technologies, reference is made to an RLC oscillation circuit 30 of FIG. 4 to change the voltage over a LC-pixel 16 from one voltage level to another voltage level. The resistance R is the equivalent resistor of the switch 32 (labeled $S_w$) connecting the LC-pixel 16, representing a subset of LC-pixel capacitances (see below) to the inductor 34 (labeled L). Inductor 34 is terminated at one side to a voltage node $V_{a/2}$, preferably half the value of the desired voltage level of the LC-pixel 16. In the preferred embodiment bias capacitances 36 and 38 (labeled $C_{b1}$ and $C_{b2}$) are equal to each other and much greater than the total sum of capacitances of the subset LC-pixels 16 that could be connected to the inductive element 34.

Figure 5:
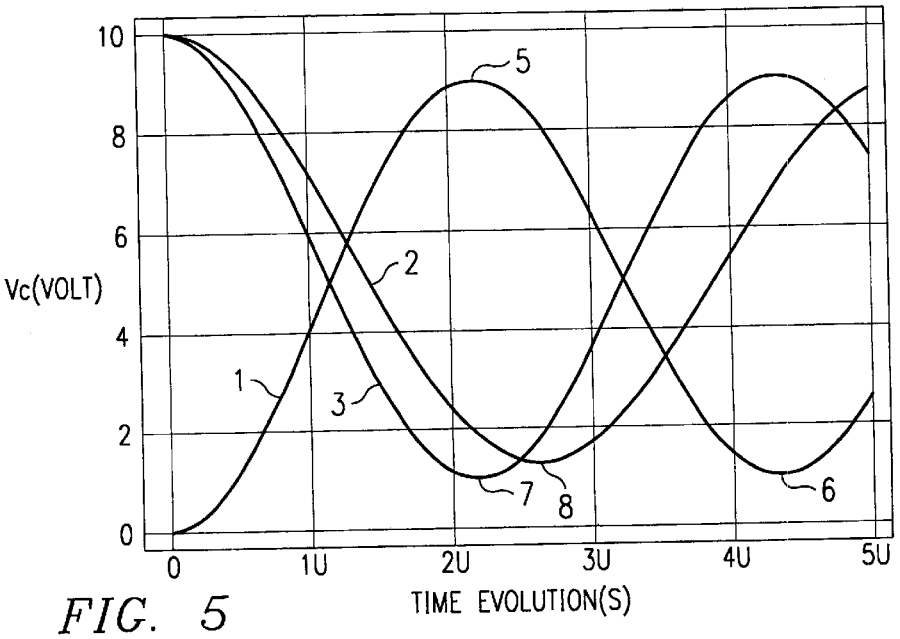
FIG. 5 shows different time evolutions of voltage change of the LC-capacitance where discharging is shown for two different values of the LC-capacitance.

First one assumes that the voltage over the capacitance 16 is zero when the switch is open (t<0). The inductance is connected to the voltage $V_a/2$. At the moment when the non-ideal switch 32 with a series resistance R is closed, a well-known oscillation, as shown in FIG. 5, starts to charge the capacitance up to a voltage $V_{max}$, which is equal to $V_a$ when R=0. The voltage loss due to the presence of the non-ideal switch at each extremum $t_{ext,n}$ can be calculated as:

$$V_{loss,h}(t_{ext,n}) = \frac{V_a}{2}\left\{1 - \exp\left[\frac{-nR\pi}{\sqrt{\frac{4L}{C} - R^2}}\right]\right\}$$

The losses increase at each extremum $t_{ext,n}$ which is defined as $t_{ext,n}=n\pi/\omega$. The pulsation ω is defined as follows:

$$\omega = \frac{\sqrt{\frac{4L}{C} - R^2}}{2L}$$

In the case of a 2-terminal AMLCD, an additional loss, however, is introduced. This loss is equal to $V_{td}$ and due to the voltage drops over the nonlinear elements. The voltage $V_a/2$ determines the mid-voltage around which the oscillation takes place.

Referring now to FIG. 5, when one wants to bring the voltage from a first value (0 in this example) to a second value (10 in this example) the oscillation 1 is interrupted at a maximum or local extreme voltage (preferably the first maximum or local extreme voltage 5 to minimize the loss). When one wants to send a pulse the oscillation is interrupted at the second (or more general at an even) extremum 6.

Figures 6, 6A:
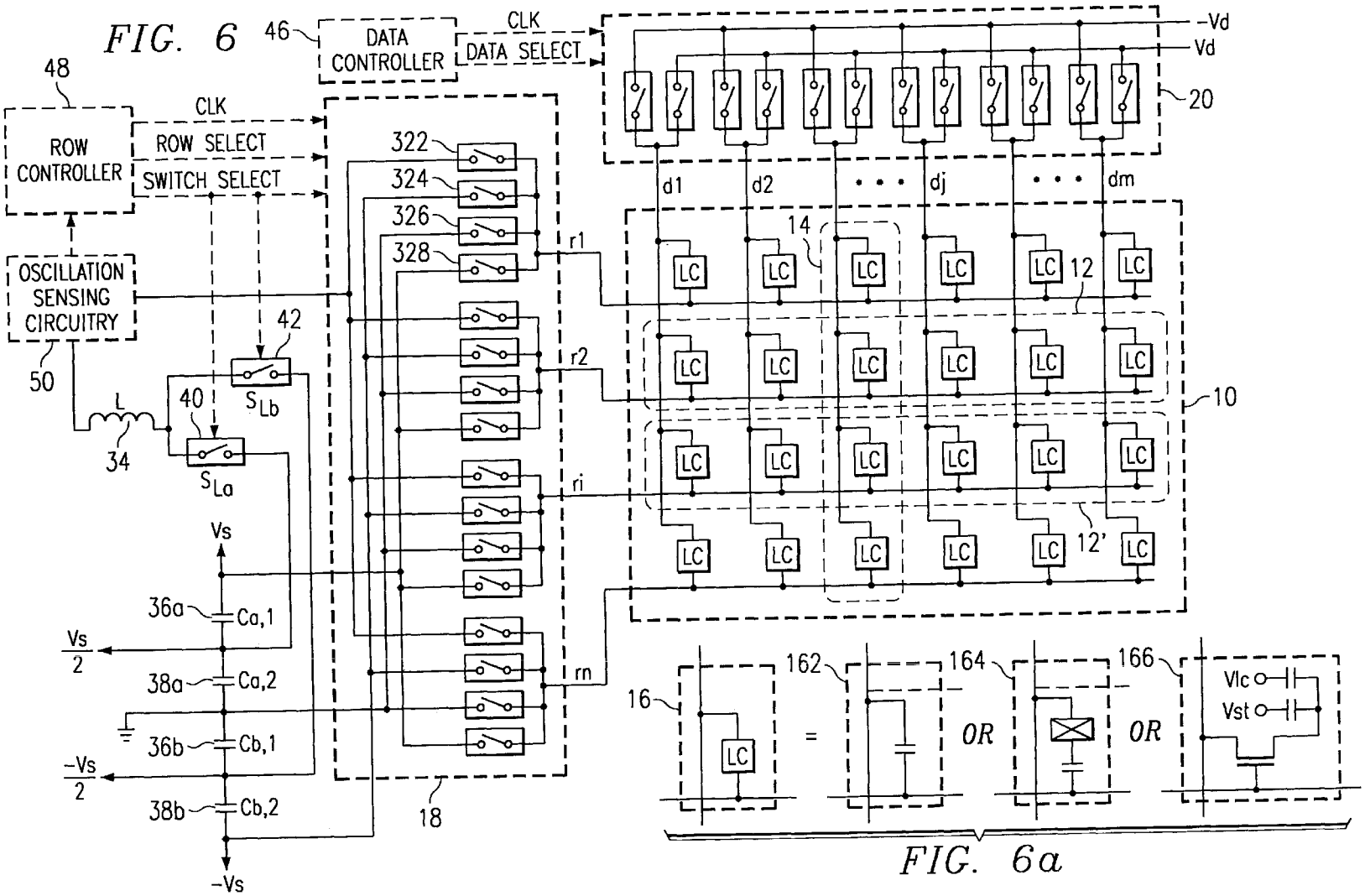
FIG. 6 is a schematic diagram of a first preferred embodiment of row driving circuitry for a general LCD, including one inductive element and one oscillation sensing circuitry (OSC).
FIG. 6*a* shows three possible pixel arrangements for the circuit of FIG. 6.

FIG. 6 illustrates an array of LC pixels 12 and the corresponding drive circuitry. When one considers the possible set of capacitors as one row 12 of capacitors 16, the oscillation pulsation for each row 12 of pixels 16 connected via the row switch 322 can be considered as constant. When one considers the possible set of pixel capacitor 16 as a subset of the columns 14, requiring the same voltage change, the oscillation pulsation differs for each number of columns 14 of pixels 16 as illustrated in FIG. 5 for curves 2 and 3. As a consequence, the extrema 7 and 8 in time and the voltage loss depend here on the data fed to the different columns of the LC-pixels 16.

In a first preferred embodiment, an inductive element 34 is connected to the mid-voltage levels $V_s/2$ and $-V_s/2$ by means of two switches 40 and 42 (labeled $S_{LA}$ and $S_{LB}$) as illustrated in FIG. 6. The columns 14 are selected as described with respect to FIG. 1. The mid-voltage levels $V_s/2$ and $-V_s/2$ are provided by bias capacitors 36*a,b* and 38*a,b*. Each row 12 has four switches 322, 324, 326, 328 in parallel. As an example, a switch 322,324,326,328 (or 40 or 42) can comprise any means for temporally connecting a first node to a second node. In the preferred embodiment, the row driver 32 may comprise a set of pass transistors (e.g., bipolar or FET—n-channel or p-channel), a CMOS switches or a BiCMOS switches.

One of the switches 322 is connected to the inductive element 34 and the other 3 switches 324, 326, 328 are connected to the $-V_s$, ground and $V_s$., respectively. This first embodiment applies to all kind of matrix LCDs. In the case of three-terminal AMLCDs, however, the negative select voltage branch of the circuit is omitted the number of switches at each row to three and eliminating one switch 42 at the inductance node.

The driving cycle starts with the classic switching of the data lines and consequently one of the rows 12 is connected to the inductive element 34 for a positive or negative half-period swing. In the case of a positive swing the switch 40 ($S_{LA}$) is closed, in the other case switch 42 ($S_{LB}$) is closed. FIG. 5 shows the timing of the voltage changes. All the other rows are tied to the ground level. After half a period when the first extremum is reached, the oscillation should be interrupted. Afterwards, the small voltage loss $V_{lost}$ can be restored by snapping the pixel 16 to the requested select voltage level $V_s$ by means of switch 328.

After the snap, the row 12 is held during the select time to the select voltage level $V_s$ or $-V_s$. Afterwards, the row (12) of pixels (16) swing back to the ground level. The return to ground can be accomplished by once again connecting the line 12 to inductive element 34 and oscillating for half a period. Again, reference can be made to FIG. 5. After this swing, the row 12 is again grounded.

In the next step all the data values are again changed for the next row 12' in the same way. The next row 12' will oscillate to the requested row voltage $V_s$ or $-V_s$. Depending on the inversion method used, this will be the same or the opposite row voltage with respect to the previous row. In the frame inversion technique, the row voltage changes sign only after every frame. In the row inversion method the voltage connection changes its sign at each new row operation. This cycles repeats after every frame time.

As stated, the oscillation is preferably interrupted after the first half period. Hence an oscillation sensing circuitry (OSC) 50 should be included to interrupt the oscillation at the right moment. Such OSC 50 can be implemented in several different ways. As the number of pixels per row is constant, the oscillation period should be almost constant. The values of the inductor 34 is chosen in accordance with the available charging and discharging time of the pixels 16 of one row 12.

Figure 7:
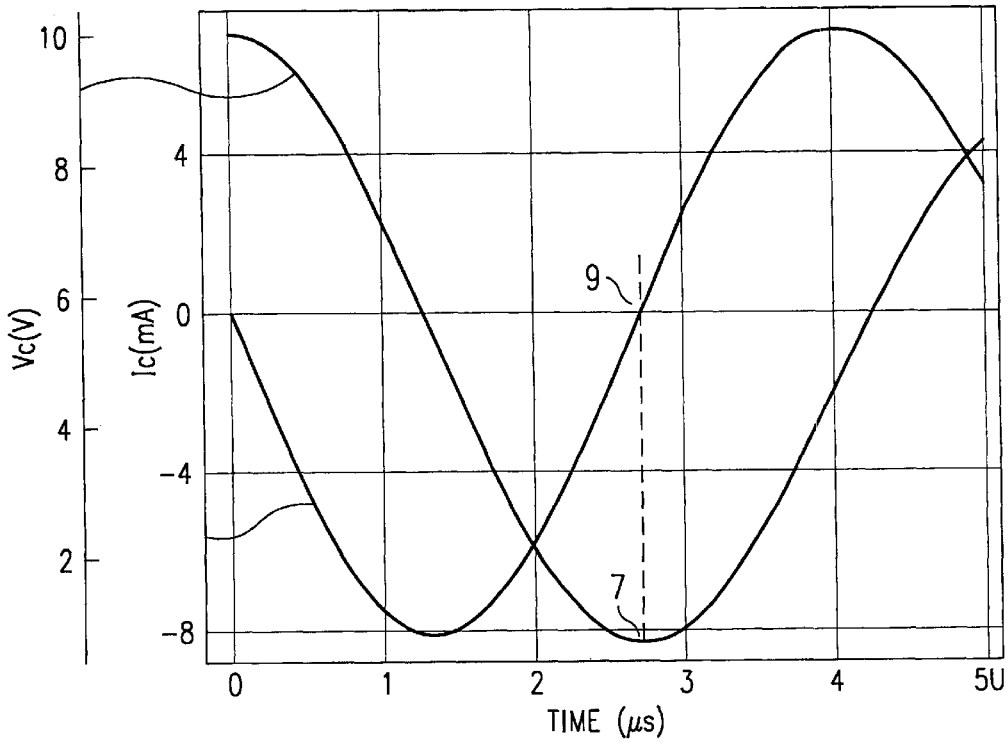
FIG. 7 shows the combined time evolutions of voltage and current change of one LC- row.
Figure 8:
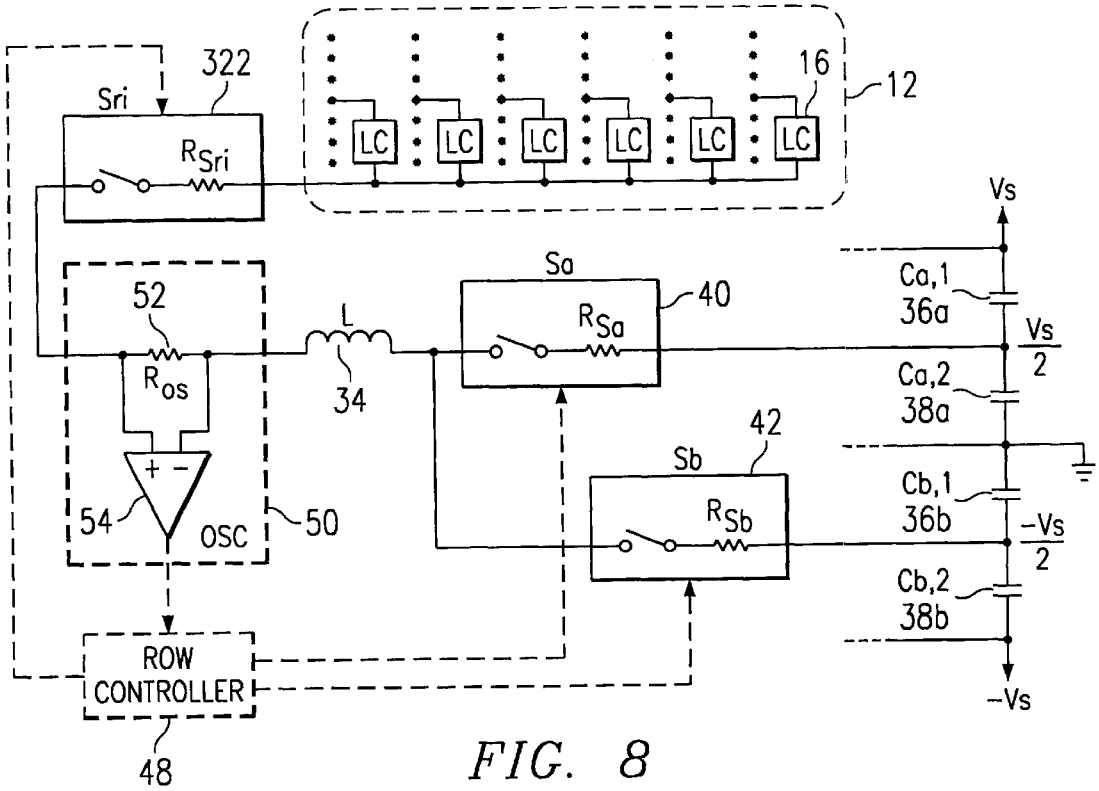
FIG. 8 indicates a first preferred implementation of the OSC.
Figure 9:
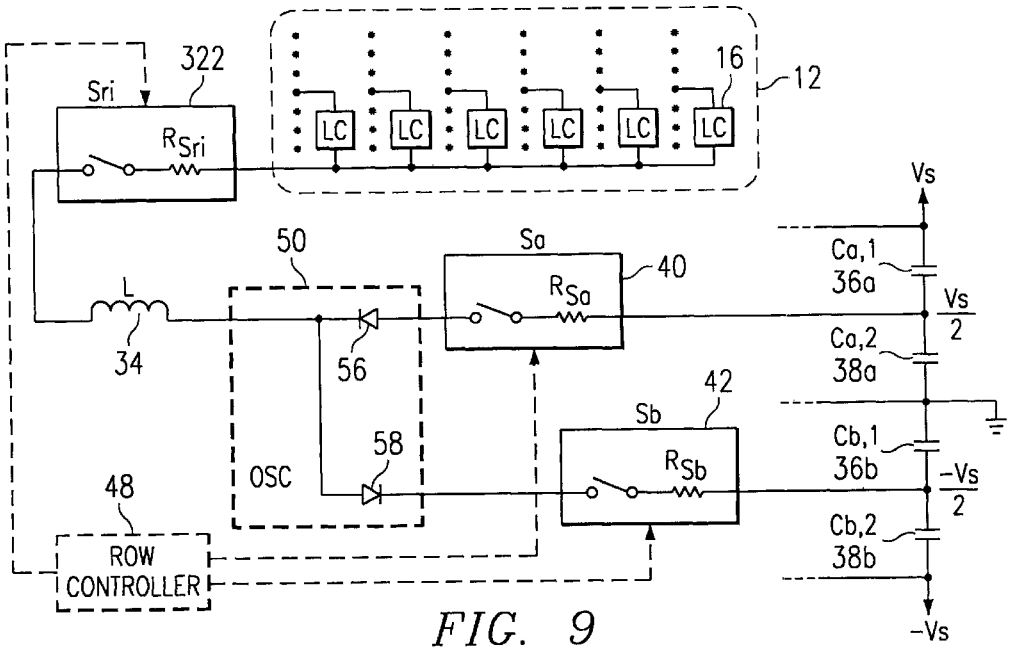
FIG. 9 indicates a second preferred implementation of the OSC.

Various circuits, which can be used for this purpose, are illustrated in FIGS. 8 and 9. These OSCs 50 can be easily understood with reference to FIG. 7 where the current and the voltage changes are illustrated in a single diagram. The extrema 7 of the voltages coincide with moments of current reversal 9 in the oscillation circuit. The sensing of the current reversal 9 is more adequate than the sensing of the voltage extrema 7. The OSCs described below focus on the current behavior of the oscillation.

In a first embodiment of an OSC 50, a current inversion detection circuit as illustrated in FIG. 8, could be used. An appropriate resistor 52 can be included in the oscillation circuit 50. The voltage over the resistance 52 is sensed by an operational amplifier 54, which operates in the comparator mode. The two possible values of the comparator output are determined by the current direction. When the current reverses its direction the output of the comparator will switch from its first to its second value. The row controller 48 detects the output change and can generate a signal to open again the row switch 322 (Sri) to interrupt the oscillation. As the period of the oscillation is quite large a small timing error due to offset errors of the operational amplifier 54 is not dramatic.

The row controller 48 has full control over the four switches 322, 324, 326, 328 (see FIG. 6) of the row driver 32 of each row 12 and the two common inductor switches 40, 42 ($S_A$, $S_B$). One of the switches 322 is connected to the inductive element 34 and the other three switches 324, 326, 328 are connected to −Vs, ground and +Vs, respectively. When closing one of these switches 324, 326, 328, a current path is formed between the group of pixels and the corresponding voltage node of that switch.

FIG. 9 illustrates a second embodiment matrix that includes an alternate embodiment OSC 50 based on the phenomenon that the current changes its direction when the pixels 16 of the selected row 12 are charged to the extremum voltage value 5, 7 or 8. In this embodiment, diodes 56 and 58 are included between each inductor switch 40 and 42 (Sa and Sb) and the common node of the inductor 34. The diodes 56 and 58 are connected in anti-parallel (that is, the anode of diode 56 is coupled to the cathode of diode 58, and vice versa).

Depending on the oscillation cycle (positive or negative), switch 40 or 42 is closed. When the pixels 16 of a row 12 oscillate from the ground level to the positive select level, the switch 40 is closed causing the current to flow from the mid-level voltage node Vs/2 towards the pixel capacitances. At the moment when the extremum voltage level is reached, the current cannot reverse due to the blocking diode 56. Hence the oscillation automatically stops. This diode circuit 50 can be combined with a clocked circuit (not shown), whose period is at least equal to the maximum estimated swing period. The diode 56 (58), however, introduces extra losses. Therefore, the diode 56 (58) is preferentially used when the select voltage levels are large in comparison with the diode drop voltage. The preferred diode type is a Schottky diode.

When the pixels of one row 12 change their voltage from the deselect to the select level, a particular loss can be estimated. This loss can be anticipated by increasing the voltage slightly such that the snap is not really needed, thereby simplifying the circuit. When the row of pixels is deselected after the select time, the pixel voltage swings to ground again. This eventual loss is now immediately restored by grounding the pixel.

Figures 10, 10A:
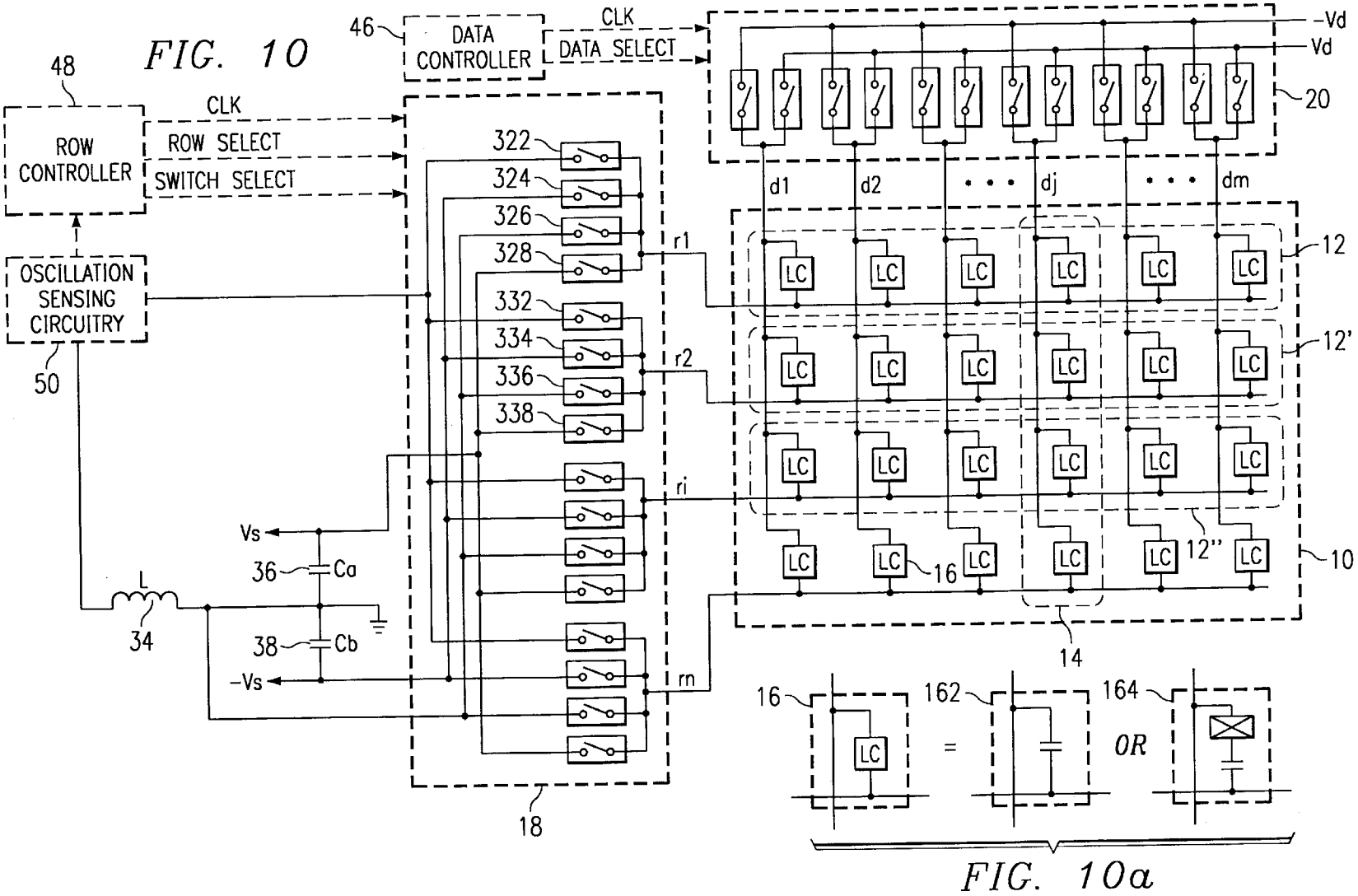
FIG. 10 indicates a schematic diagram of a second preferred embodiment of row driving circuitry for a PMLCD and a two-terminal AMLCD, including one inductive element and one Oscillation Sensing Circuitry.
FIG. 10*a* shows two possible pixel arrangements for the circuit of FIG. 10.

In an alternate embodiment, the oscillation cycle is partitioned over two consecutive rows 12 as illustrated in FIG. 10. This implementation is preferably applied to PMLCDs and two terminal AMLCDs with their basic pixel elements 162 and 164 respectively. The number of switches at each row driver 32 is unchanged with respect to the first preferred embodiment (FIG. 6). Each row 12 again has one switch 322, which provides the connection to the common node of the inductive element 34. The other node of the inductive element 34 is here, however, tied to the ground.

The driving cycle will now be described. At the end of the row select time of a row 12, the row 12 is set to the deselect voltage level again. This is effectuated by sending a control signal from the row controller 48 to the driver 32. The control circuit causes switch 322 to connect row 12 to the common node of the inductive element 34. Consequently the pixels 16 of row 12 will oscillate to the inverse polarity of the select voltage.

This oscillation should be interrupted when the ground level is reached. At the moment of this interruption, all the capacitive energy of the pixels 16 of row 12 is transformed into magnetic energy of the inductive element 34. The row 12 is tied to ground by means of switch 326 of row driver 32. This inductive energy can be reused to select the next row 12'. This row 12' can oscillate to the opposite polarity of the select voltage level when the row controller 48 sends a signal to connect the next row 12' to the common node of the inductive element 34 by means of switch 332 of row driver 33. This circuitry immediately features the row inversion technique.

Figure 12:
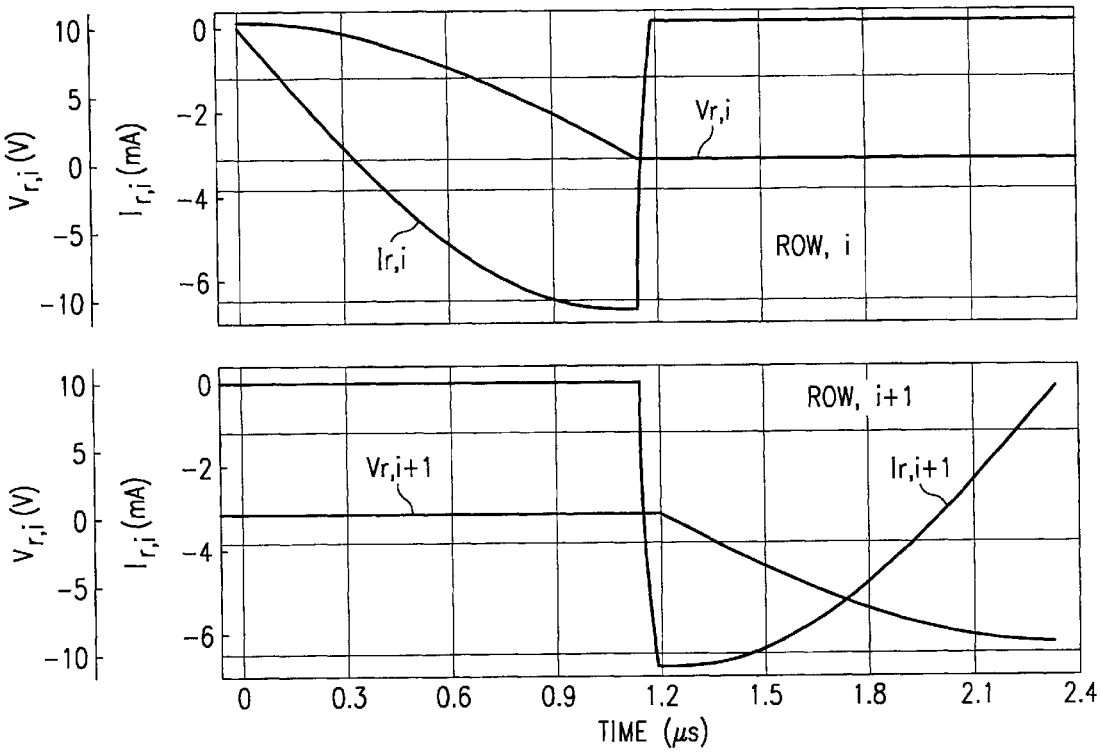
FIG. 12 shows the combined time evolutions of voltage and current change of two consecutive LC- rows of inter-row transfer.

The second phase of the oscillation should be interrupted when all the magnetic energy is converted in capacitive energy of the pixels 16. The timing of the interruption of both phases of the oscillation can be controlled by means of appropriate oscillation sensing circuitry 50. At the end of the oscillation, when row 12 is snapped to its extreme value 5, 7 or 8 by means of switch 334 or 338, the classic switching of the data lines is effectuated. After the snap, the row 12' is held during the select time to the select voltage level $V_s$ or $-V_s$. Afterwards, the row 12' of pixels 16 swing again to the ground level in a two-phase oscillation cycle involving row 12' and row 12". This cycles repeats after every frame time. The time evolution of the pixel voltages on rows 12' and 12"are shown in FIG. 12.

Figure 11:
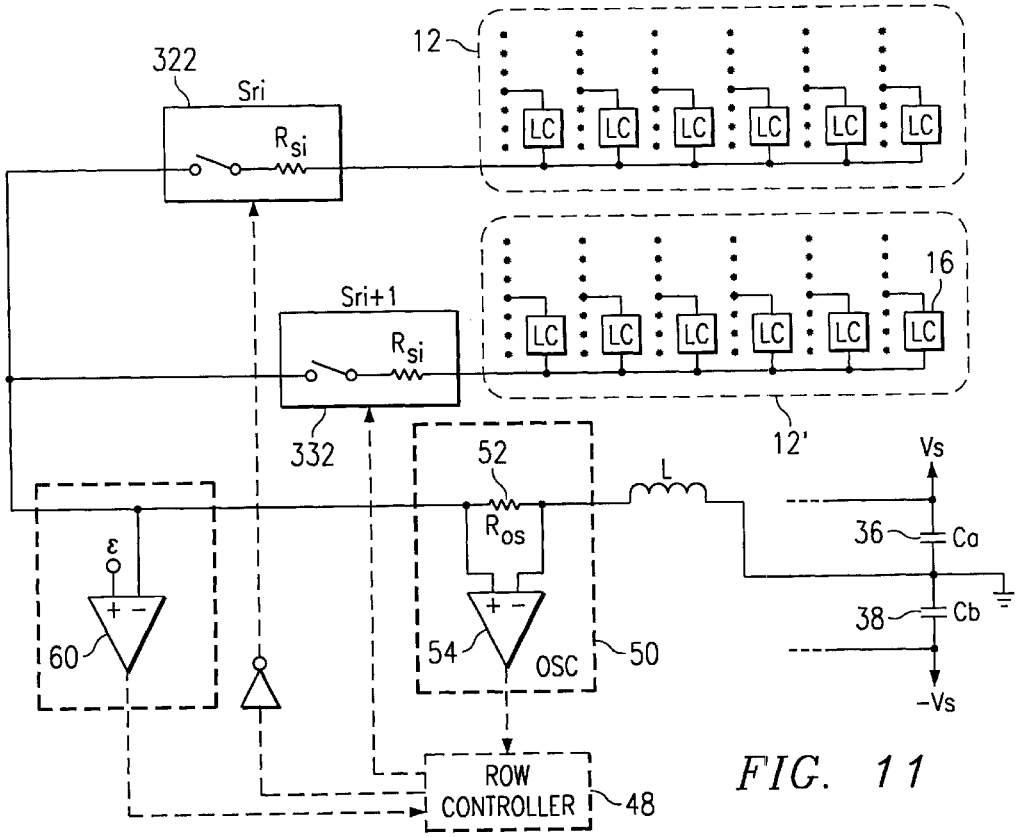
FIG. 11 indicates a preferred implementation of the OSC for inter-row transfer.

A first embodiment of the oscillation sensing circuitry 50 for the inter-row transfer circuitry is illustrated in FIG. 11. First a comparator 60 is added to the oscillation circuitry 50. One input of the comparator 60 is connected to the RLC circuit and the second input is connected to a small voltage $\epsilon$. This small voltage value $\epsilon$ is provided to interrupt the oscillation, started by sending a signal from the row controller 48 to close the switch 322 when the voltage reversal is almost accomplished. When this comparator 60 changes its output state, the row controller will disconnect row 12 and will connect row 12'. At the moment of switching from one row to another the current is maximum. Hence the current should be allowed to continue to flow.

Secondly, an appropriate resistor 52 is added to the oscillation circuit 50. The voltage over the resistance 52 is again sensed by means of the operational amplifier 54 operating in the comparator mode. When the current reverses its direction, the output of the comparator 54 will switch from its first to its second value. The row controller 48 detects the output change and can generate a signal to open again the row switch $S_{r,i+1}$ 332 to interrupt finally the oscillation. As the period of the oscillation is quite large a small timing error due to offsets errors of the operational amplifier 54 is not dramatic. The row controller 48 has full control over the four switches 322, 324, 326, 328 of each row driver 32 of each row 12.

The optical output of a LC pixel 16 is in accordance with the RMS-voltage imposed on the pixel 16 during a frame time. The LC-pixel cannot respond to fast voltage changes. As such, the classic rectangular voltage pulse imposed on the pixel during the row operation could be replaced by an equivalent sinusoidal shaped pulse. It is generally known that a sinusoidal voltage is equivalent to a square voltage pulse when the amplitude of the sinus wave is equal to $V_{sinus} = \sqrt{2}V_{sq}$.

Figure 13:
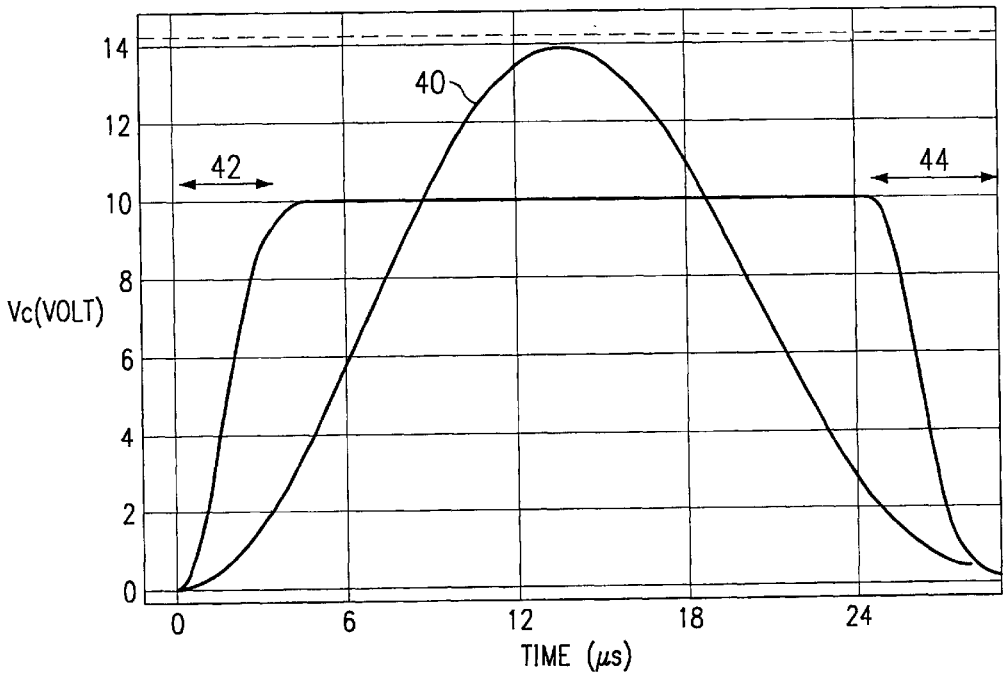
FIG. 13 compares the time evolution of the voltage change of a full-period oscillation and a double half-period oscillation.

In another preferred embodiment the circuit oscillates over a full-period as illustrated by the oscillation 40 in FIG. 13. When one allows an oscillation over the full period instead of two half-period oscillations 42 and 44 over a very short interval the select period, one can easily calculate that the electrical power dissipation can be further reduced.

$$V_{loss,h}/V_{loss,f} = 2\frac{V_a}{2}\left\{1-\exp\left[\frac{-R\pi}{\sqrt{\frac{4L}{C}-R^2}}\right]\right\}\Big/\sqrt{2}\,\frac{V_a}{2}\left\{1-\exp\left[\frac{-2R\pi}{\sqrt{\frac{4sL}{C}-R^2}}\right]\right\}$$

Figure 14:
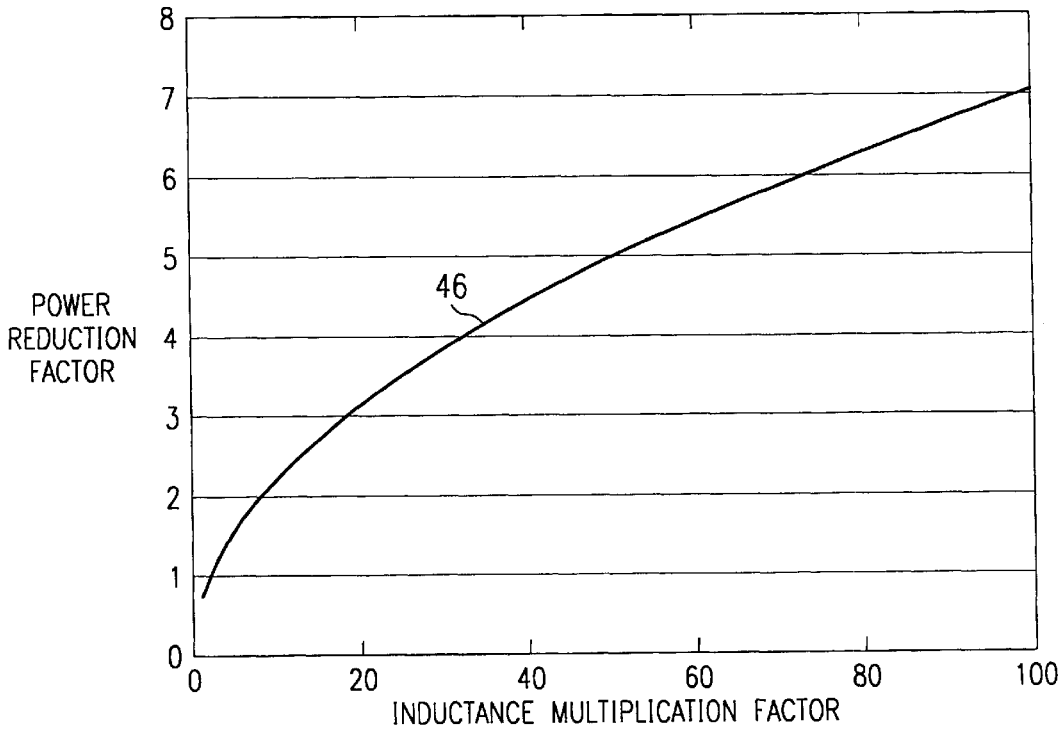
FIG. 14 indicates the expected power reduction factor of a full-period oscillation implementation with respect to a double half-period oscillation implementation.

The losses for both systems are compared by power reduction curve 46 in FIG. 14. Because the system can oscillate longer and slower, the inductance value can be increased with a factor s. Speed reduction is proportional to $\sqrt{s}$. Realistic values for s are between about 20 and 100. This leads to a power reduction of about a factor 3 to 7, as illustrated. Typically, a full-period system is preferred since the speed of the oscillation is largely reduced and the power dissipation drastically reduced.

Figure 16:
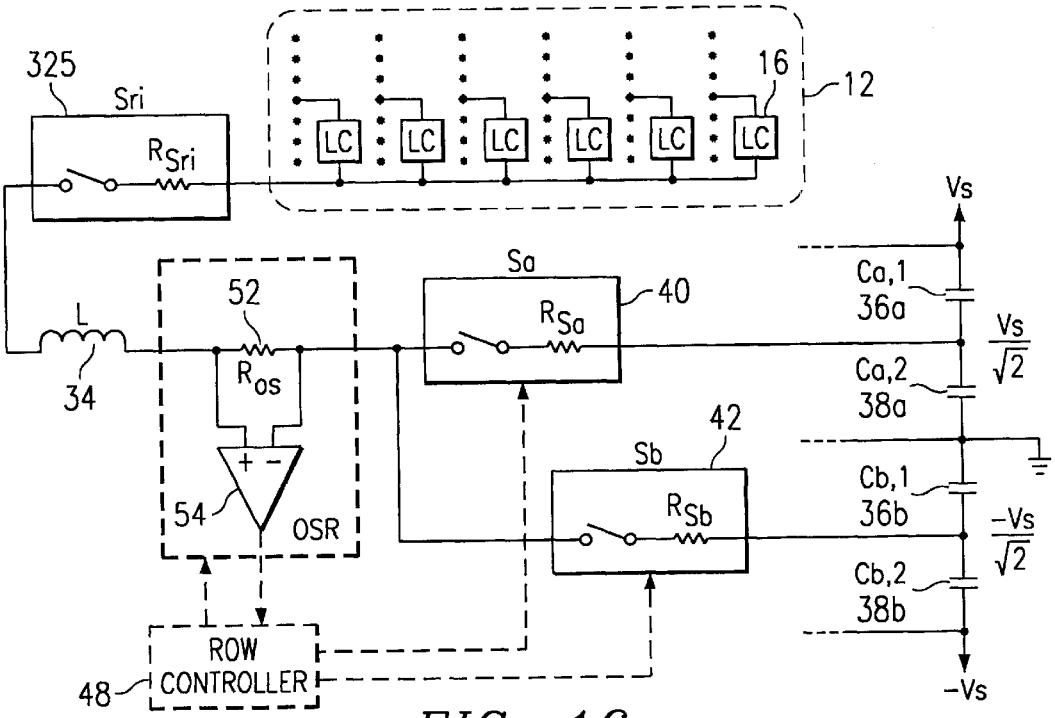
FIG. 16 indicates a preferred embodiment of the OSC of the full-period oscillation implementation.
Figures 15, 15A:
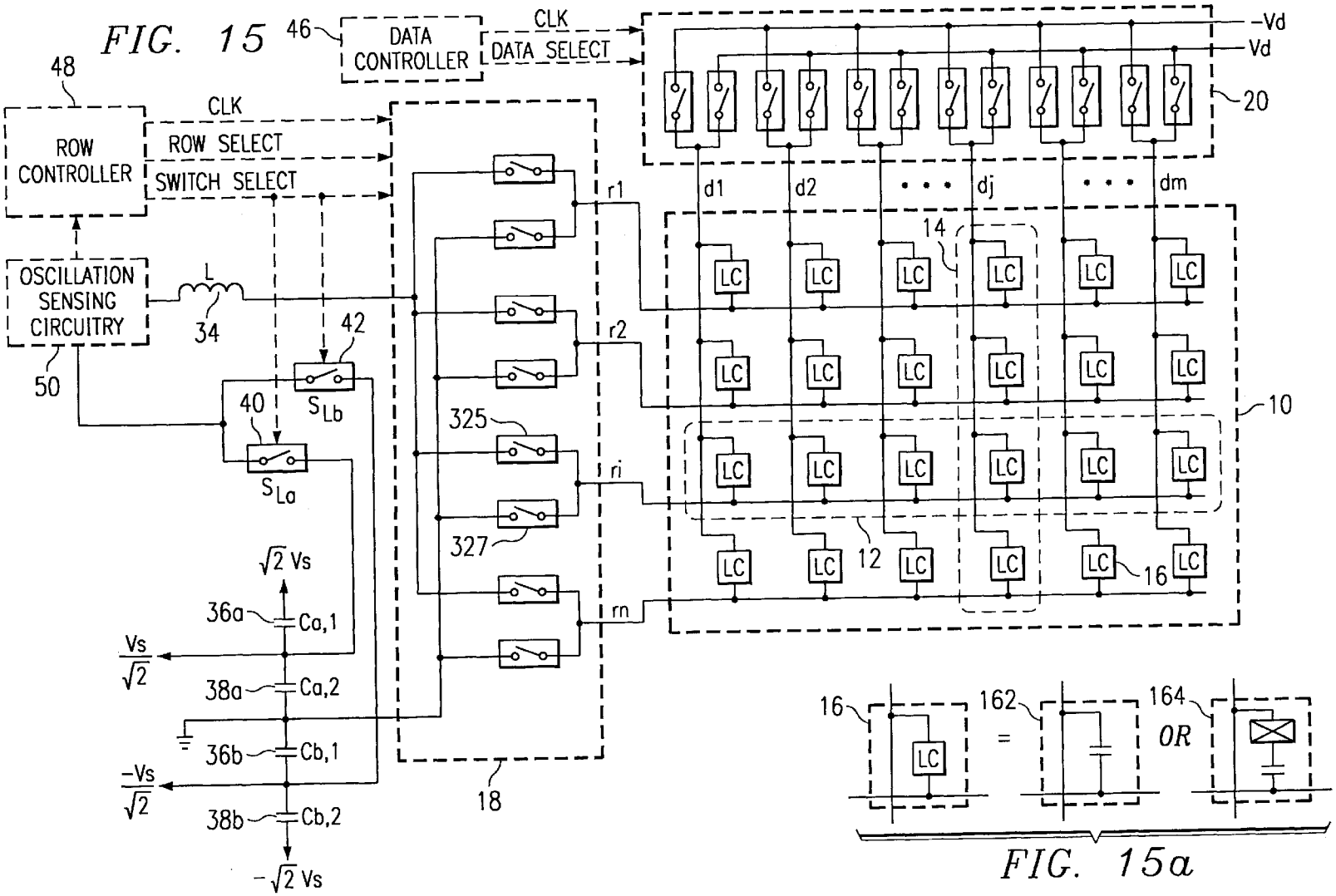
FIG. 15 indicates a schematic diagram of a third preferred embodiment of row driving circuitry (e.g., full-period oscillation implementation) for a PMLCD and a two-terminal AMLCD, including one inductive element and one Oscillation Sensing Circuitry.
FIG. 15*a* shows two possible pixel arrangements for the circuit of FIG. 15.

The preferred circuits are illustrated in FIGS. 15 and 16. This principle can be applied to a PMLCDs and 2-terminal AMLCDs with the elementary pixel element 16 represented by 162 and 164. The charging and discharging of the gates in a 3-terminal AMLCD is preferentially not executed in a full-period mode due to capacitive coupling between rows and the columns via the gates.

The bias voltage applied to inductor 34 is now about $\pm Vs/\sqrt{2}$ instead of about $\pm Vs/2$. (In cases where the reference voltage is not zero, the bias voltage can be expressed as about the reference voltage plus one over the square root of two times the absolute value of the difference between the high voltage and the reference voltage.) This bias voltage is chosen such that the effective value seen by the pixel 16 is the same as that of an equivalent rectangular pulse ($V_{eff}=\sqrt{2}V_{half}$). In this preferred circuit, the number of switches at each row driver 32 of each row 12 can be halved with respect to the half-period swings. One of the switches 327 of a row connects the row to the ground level, while the other switch 325 provides the connection to the common node of the inductive element 34. This inductive element 34 is connected at its other termination to two switches 40 and 42. Depending on the required polarity of oscillation the switches 40 and 42 provide a connection to the positive or negative bias levels provided by means of the bias capacitors 36 and 38. In order to interrupt the oscillation of the row LRC circuit, an oscillation sensing circuit 50 is provided.

A first embodiment of the OSC 50, detailed in FIG. 16, is again added to the oscillation circuit. The voltage over the resistance 52 is sensed by an operational amplifier 54 operating in the comparator mode. The two possible values of the comparator output are determined by the current direction. When the current reverses its direction the output of the comparator 54 will switch from its first to its second value. The row controller 48 detects the output change. In this full-period oscillation implementation the row controller 48 may only generate a signal to open again the row switch 325 (Sri) to interrupt the oscillation, after the second output change of the comparator, i.e., after the second current inversion. As the period of the oscillation in this implementation can be large a small timing error due to offset errors of the operational amplifier 54 is not dramatic. The row controller 48 has full control over the two switches 325 and 327 of each row driver 32 of each row 12 and the two common inductor switches 40 and 42.

Figure 17:
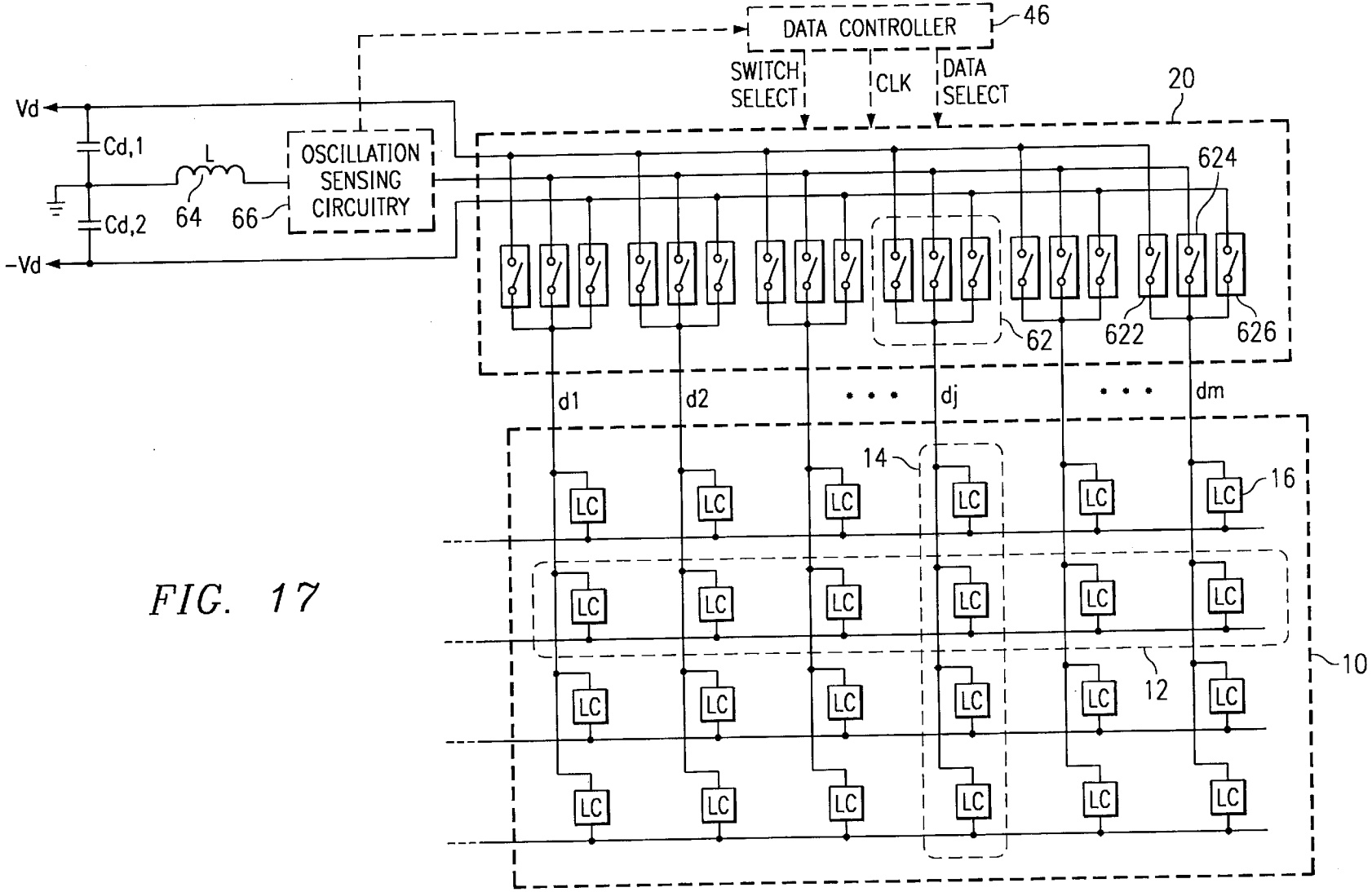
FIG. 17 indicates a schematic diagram of a data driving circuitry for a general matrix LCD, including one inductive element and one Oscillation Sensing Circuitry.

FIG. 17 illustrates another embodiment where the oscillatory driving circuit of the row driver described above is applied to data driver circuitry. In this embodiment the oscillatory driving circuit is shown for the column only but it is understood that it could be used for both of them. A person skilled in the art can decide depending on the type and size of the LCD where the implementation of the new RLC driving circuitry is most fruitful, in the row driver, column driver or both of them.

The column data swing between $\pm V_d$. In this preferred embodiment, each column 14 has a column driver 62 consisting of three switches 622,624,626. A first switch 624 of each column 14 is connected to the common node of the inductive element 64. This inductive element 64 is terminated at the other side to the ground. The other two switches 622 and 626 provide the snap connection to $\pm V_d$ respectively. The number of columns 14 connected to the inductive element 64 is here dependent on the incoming pixel data. As a consequence the oscillation characteristics such as speed and losses are data dependent as was illustrated by the oscillation curves 2 and 3 of FIG. 5.

In a first preferred column driver circuitry, the sequential or two-phase version is implemented. The subset of pixels of the selected row 12, which were negative and need to become positive are connected in the first phase to the common node of the inductive element. The subset of pixels of the said selected row 12, which were positive and need to become negative are connected in a second phase to the inductive element. Some data won't change sign and hence a subset of pixels 16 won't be connected to the inductive element 64 during this select time interval. the column driving circuitry, the oscillation period and the induced losses are data dependent as previously discussed with respect to FIG. 5. The different interrupting and snapping circuits discussed above with respect to the row operations can be also be used for the columns. Different combinations of the circuits can be used. In other words, the row can include one embodiment interrupting circuit while the column uses a different embodiment interrupting circuit. Alternatively, the same interrupting circuit could be used for each.

When the data are set before the rows are selected, the column oscillation is a half-period swing with its period much shorter than the data select period. When the data have been loaded into the pixels capacitances, the rows 12 can be again loaded in either a half or a full-period oscillation, the full-period oscillation being preferred.

After the row, has been charged and discharged the data can be again loaded for the next row operation. The period as well as $V_{loss}$ are in general different for both phases.

The interruption of the oscillation tends to be important now since the oscillation time is not known in advance. Hence a fixed clocked system is not preferred in this case.

The self-interrupting diode circuits (see e.g., FIG. 8) or current reversal detecting circuit (see e.g., FIG. 9) can be implemented. After switching, the snapping circuit should be applied to tie each pixel to its required voltage level.

Figure 18:
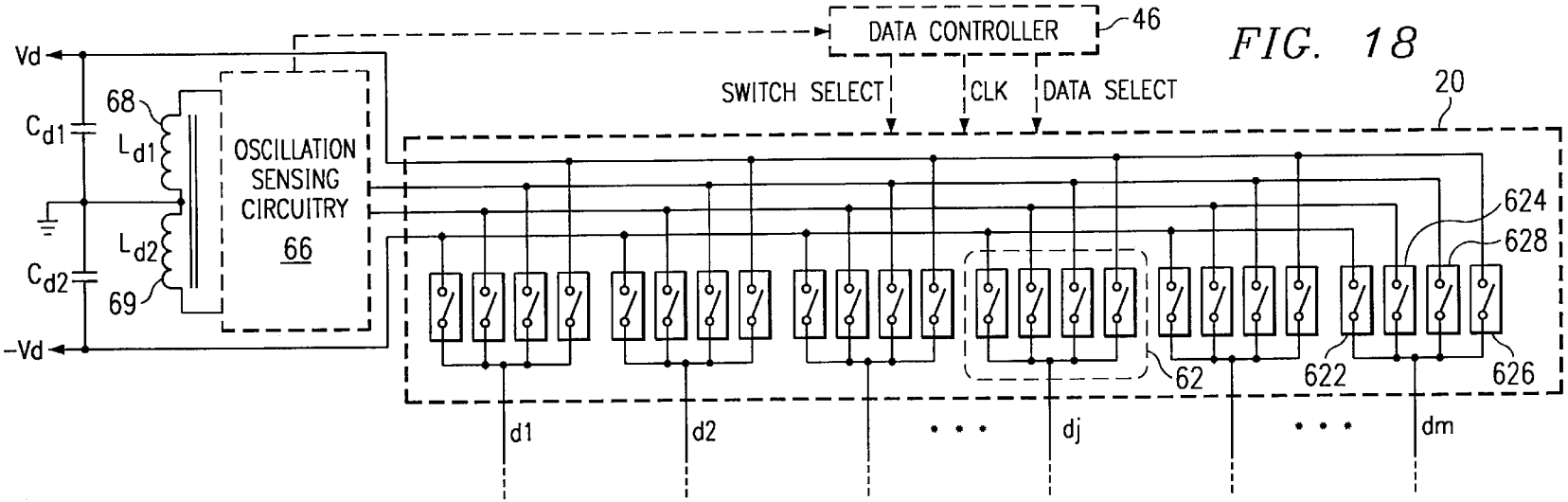
FIG. 18 indicates a schematic diagram of a data driving circuitry for a general matrix LCD, including two mutually coupled inductive elements and one Oscillation Sensing Circuitry.

The upward swinging columns and the downward swinging columns can be connected in a concurrent way as illustrated in FIG. 18. In this preferred implementation two inductive elements $L_{d1}$ and $L_{d2}$ are provided. The inductive elements $L_{d1}$ 68 and $L_{d2}$ 69 are mutually coupled. With their common node being tied to ground. The number of switches at each column driver 62 has increased by one with respect to the sequential implementation.

The extra switch 628 provides the connection to the second inductive element. The subset of columns-which need to change their voltage from positive to negative are coupled and to the first inductive element $L_{d1}$ 68. The subset of pixels 16 which need to change their polarity in the reverse direction are coupled to the other inductive element $L_{d2}$ 69. Both oscillations can occur concurrently in this way. In the case when the two inductive elements $L_{d1}$ 68 and $L_{d2}$ 69 are strongly mutually coupled, the two oscillations evolve in phase even when the number of upwards switching columns differs from the number of downward switching columns.

The column data swing between ±Vd. in this preferred embodiment, each column 14 has a column driver 62 consisting of three switches 622, 624, 626. When closing one of these switches, a current path is formed between the group of pixels and the corresponding voltage node of that switch.

For the case when the inductive elements are only weakly mutually coupled or in the extreme case not coupled at all, the oscillations of both subset of pixels will occur in very distinctive way. Each of the concurrent oscillations shows in that case a different $V_{loss}$ and oscillation period. In general, the concurrent operation principle is faster, the sequential is less complicated and consumes less driver chip area.

Figure 19:
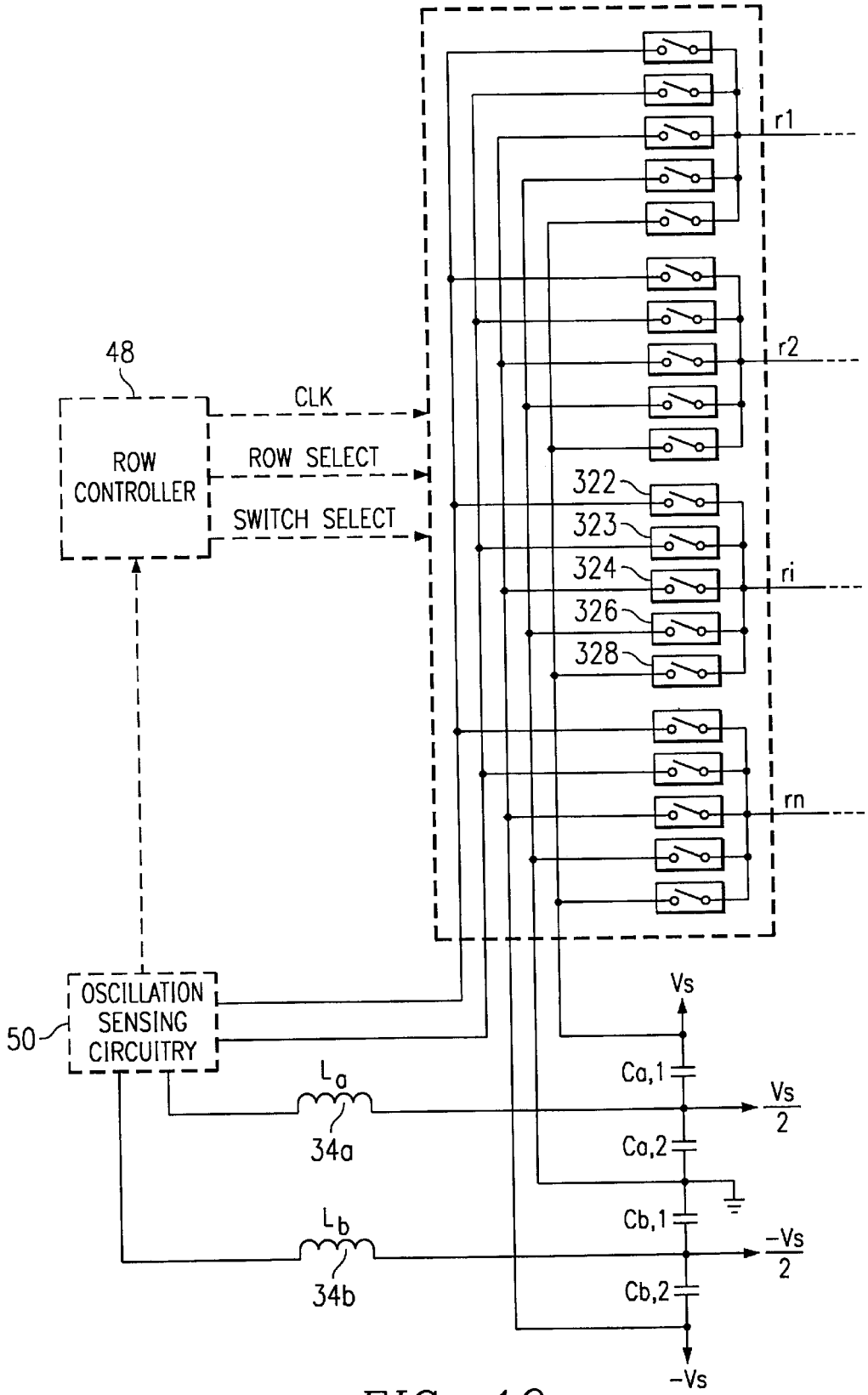
FIG. 19 indicates a schematic diagram of a row driving circuitry for a general matrix LCD, including two inductive elements and one Oscillation Sensing Circuitry.

The two inductive element concept can be implemented for the row driver system as well. In that case the number of switches at each row driver 32 increases from 4 to 5 when one changes the system for one to two inductive elements as illustrated in FIG. 19. The switches 40 and 42 (see FIG. 6) between the bias voltages and the inductive elements 34 can be removed. The inductive elements 34 do not need to be mutually coupled, as both inductive elements do not carry current simultaneously.

In this case, the decision to connect the row to one of the conductors is implemented in the switches of each row driver 32. When the row needs to be driven to a positive selection voltage the inductive element La is carrying current, in the charging as well as in the discharging phase of the oscillation. This is accomplished by means of switch 322. In the other case when the negative selection voltage needs to be applied to the said row, the other inductive element is carrying current and this is accomplished by means of switch 323.

Grey level implementation can be accomplished in different ways. The proposed LRC oscillation system is compatible with amplitude and pulse width modulation. The column drivers load the data of the same polarity in a quasi-adiabatic way to the average value of the pixels of that polarity. Afterwards each data column is snapped to the particular gray level voltage. The average value is larger than the specific deviation for a particular gray scale.

Other combinations of adiabatic switching of the row and data lines can be deduced from this general idea. One of ordinary skill in the art, with the assistance of the teachings herein, will be able to expand this system to more complicated multi-level addressing schemes of LCD's, which are used to increase the display quality of the LCD. Persons skilled in the art can determine the optimum multi-level scheme (also called number of driving biases) for a LCD in accordance with the display duty cycle ratio.

Figure 21:
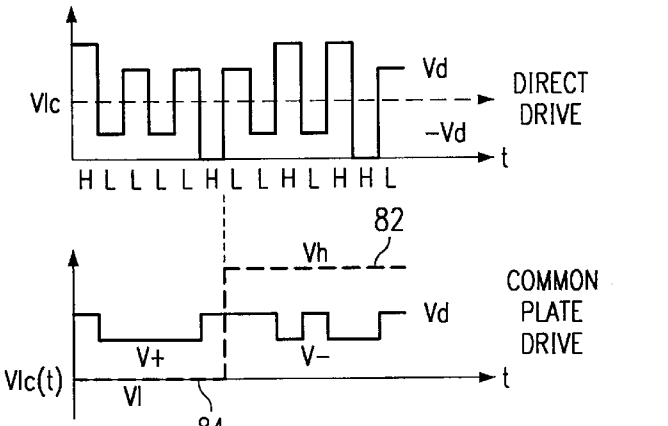
FIGS. 21*a* and 21*b* compares the timing diagram of the direct drive and common plate drive implementation.
Figure 20:
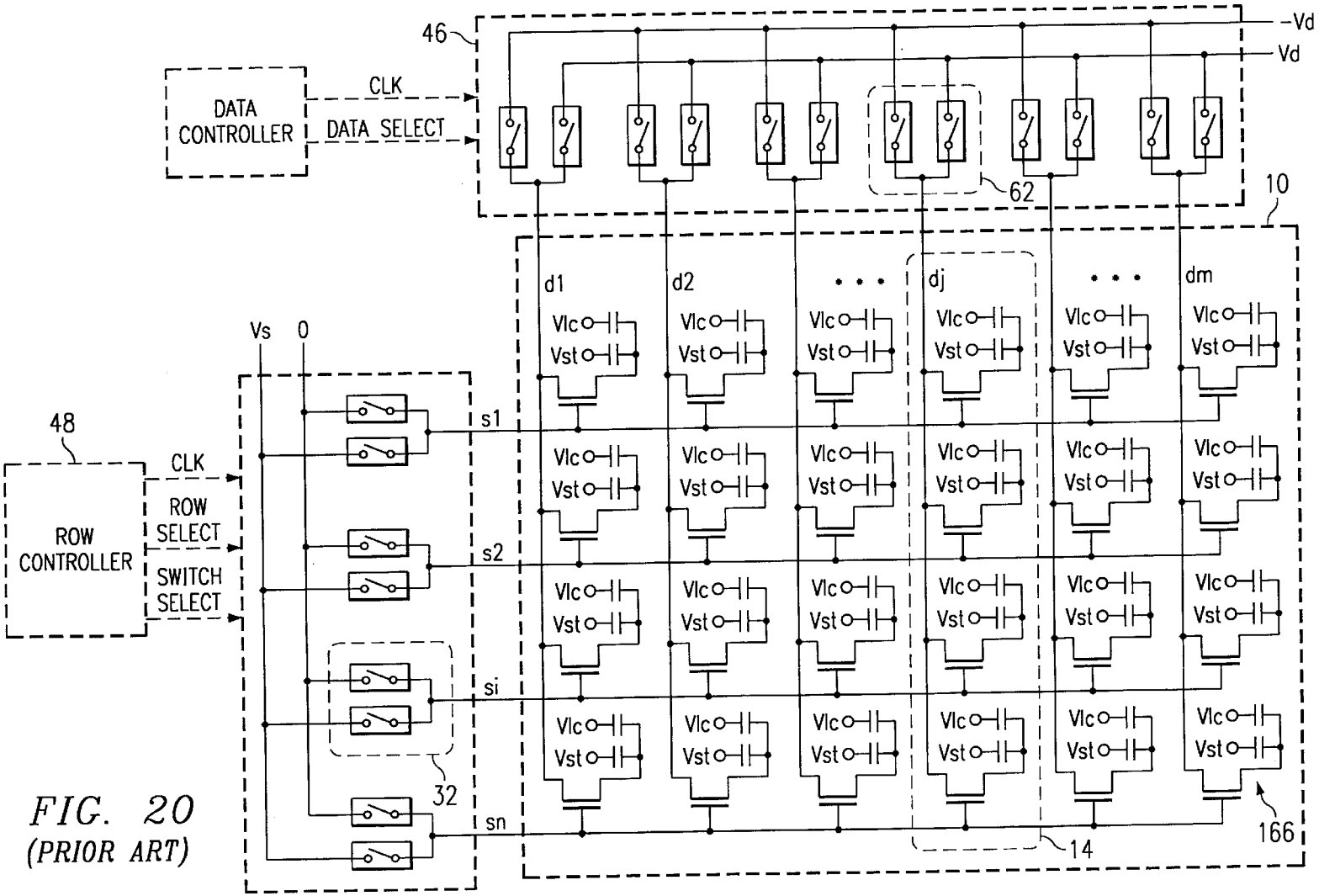
FIG. 20 (PRIOR ART)
FIG. 20 indicates a schematic diagram of a common plate driving circuitry for a known three-terminal AMLCD.

A final illustration of the present invention deals with the common plate driving of a 3T-AMLCD (three-terminal active matrix liquid crystal display). A schematic view of a prior art 3T-AMLCD is shown in FIG. 20. At each pixel location 16 the liquid crystal is connected to a common node labeled $V_{1c}$. This common node behaves like a common plate with a capacitance equal to the sum of all liquid crystal pixels. In the common plate driving implementation, the drivers exhibit unipolar characteristics as shown in the timing diagram of FIG. 21. In order to change the polarity of the pixels it is necessary to change the voltage at the common plate. The alternative to common plate driving, as shown in FIG. 21, is the direct drive scheme where the drivers can provide both the magnitude and the polarity.

Figure 22:
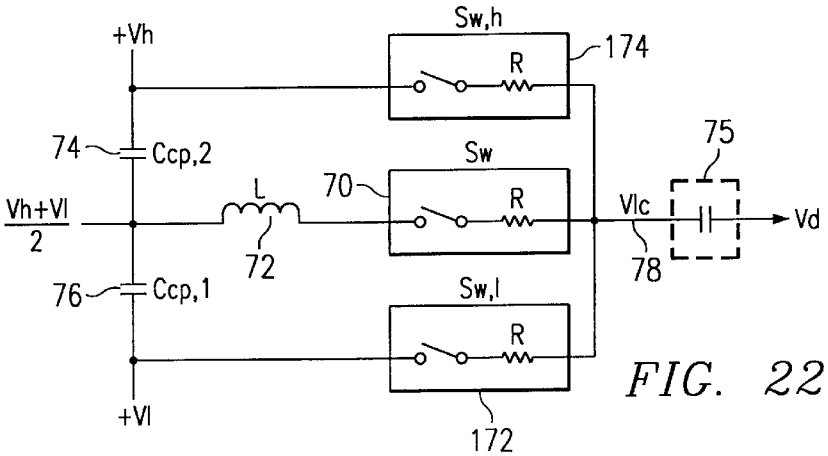
FIG. 22 indicates a preferred embodiment for the common plate driving circuitry of a three-terminal AMLCD.

Solutions to decrease the power dissipation of the direct drive scheme were previously described in preferred embodiments of the column drivers. Here we describe a new method to drive the common plate. The electric circuitry to drive the common plate 75 is relatively simple and shown in FIG. 22. The common plate node $V_{1c}$ 78 is connected by means of a switch 70 to an inductive element 72. The inductive element is biased by means of two capacitors 74 and 76 to a voltage value equal to the average of $V_H$ 82 and $V_L$ 84, the high and low value of the common node 78 respectively.

At the beginning of each frame period the switch 70 is closed to reload the common plate from its high to its low value or vice versa. The timing of the oscillation can again be controlled by means of an oscillation sensing circuitry, which is similar to the ones described in the row and or column driver circuitry. When the end of the oscillation cycle is sensed by the oscillation sensing circuitry, the oscillation is interrupted by opening switch 70. At the same time, the common plate voltage is snapped to the low or the high voltage level by means of switch 172 or 174, respectively. By means of this new method an important disadvantage of common plate driving, i.e., its power dissipation can be drastically lowered and making the common plate driving a competitive alternative for the direct drive schemes.

The present invention has thus far been described with examples of matrix displays that use two or three voltage levels to select pixels for display. The present invention is also intended to encompass displays with one or more than three select voltage levels. In a number applications, even for black-white screens without grey levels, more voltage levels are used to improve the image quality. The system of FIG. 6, for example, utilizes three voltage levels for the rows ($V_S$, ground, and $-V_S$) and with two voltage levels for the columns (+Vd and −Vd). Other displays may use more than three voltage levels for the rows. For example, commercially available drivers, such as the HD44100R sold by Hitachi, use four voltage levels for the columns and rows.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method of driving a group of pixels in a matrix display device, the method comprising:

dividing the group of pixels in first and second subgroups of pixels, wherein pixels belonging to the first subgroup require a first change of voltage level and wherein pixels belonging to the second subgroup require a second change of voltage level;

inductively coupling the first subgroup of pixels to an intermediate voltage level between a first voltage level and a second voltage level;

inductively coupling a second subgroup of pixels to the said intermediate voltage level when the first group of pixels almost reaches the intermediate voltage level;

decoupling the first group of pixels from the intermediate voltage level when the first group of pixels almost reaches the intermediate voltage level, wherein the first subgroup of pixels are kept in a high-impedance state after the decoupling; and decoupling the second group of pixels from the intermediate voltage level when the second group of pixels substantially reaches a local extreme voltage level relative to the intermediate voltage level.

2. The driving method as recited in claim 1, wherein decoupling the first subgroup of pixels is triggered by sensing a voltage reversal with respect to the intermediate voltage level in an oscillation circuit.

3. The driving method as recited in claim 1, wherein decoupling the second subgroup of pixels is triggered by sensing the current reversal in a current path of the second subgroup of pixels.

4. The driving method as recited in claim 1, wherein the second subgroup of pixels are kept in a high-impedance state after the decoupling.

5. The driving method of claim 1 wherein decoupling the first group of pixels comprises decoupling the first group of pixels from an inductive storage element.

6. The driving method of claim 1 wherein decoupling the second group of pixels comprises decoupling the second group of pixels from an inductive storage element.

7. The driving method as recited in claim 1, wherein decoupling the first subgroup of pixels is triggered by sending a voltage extremum.

8. A driver circuit for a matrix display device that includes a plurality of pixels disposed in rows and columns, the driver circuit comprising:

a first switch with a current path coupled between a reference voltage node and a group of pixels;

a second switch with a current path coupled between a high voltage node and the group of pixels, wherein the high voltage node is at a voltage greater than the reference voltage node;

a third switch with a current path coupled between an intermediate voltage node and the group of pixels, a voltage at the intermediate voltage node being between a voltage at the high voltage node and the voltage at the reference voltage node;

an inductive storage element with a current path coupled in series with the current path of the third switch, the inductive storage element coupled between the group of pixels and the intermediate voltage node;

a control circuit with outputs to control the conductivity of the first switch, the second switch and the third switch, the control circuit causing no more than one of the first switch, the second switch and the third switch to be conductive at a time; and an oscillation sensing circuitry coupled to the current path of the inductive storage element, the oscillation sensing circuit including at least one output coupled to the control circuit, wherein the oscillation sensing circuit includes a comparator with first and second inputs coupled to points in the current path of the inductive storage element and an output coupled to the control circuit and wherein the oscillation sensing circuit further includes a resistive element coupled between the first and second inputs of the comparator, the resistive element having a current path coupled in series with the current path of the inductive storage element, wherein the resistive element is a resistor separate from the third switch.

9. The circuit of claim 8 wherein the group of pixels comprises a row of pixels.

10. The circuit of claim 8 wherein the group of pixels comprises at least one column of pixels.

11. A driver circuit for a matrix display device that includes a plurality of pixels disposed in rows and columns, the driver circuit comprising:

a first switch with a current path coupled between a reference voltage node and a group of pixels;

a second switch with a current path coupled between a high voltage node and the group of pixels, wherein the high voltage node is at a voltage greater than the reference voltage node;

a third switch with a current path coupled between an intermediate voltage node and the group of pixels, a voltage at the intermediate voltage node being between a voltage at the high voltage node and the voltage at the reference voltage node;

an inductive storage element with a current path coupled in series with the current path of the third switch, the inductive storage element coupled between the group of pixels and the intermediate voltage node;

a control circuit with outputs to control the conductivity of the first switch, the second switch and the third switch, the control circuit causing no more than one of the first switch, the second switch and the third switch to be conductive at a time; and an oscillation sensing circuitry coupled to the current path of the inductive storage element, the oscillation sensing circuit including at least one output coupled to the control circuit wherein the oscillation sensing circuit includes a comparator with first and second inputs coupled to points in the current path of the inductive storage element and an output coupled to the control circuit, wherein the comparator comprises an operational amplifier.

12. The circuit of claim 11 wherein the group of pixels comprises a row of pixels.

13. The circuit of claim 11 wherein the group of pixels comprises at least one column of pixels.

14. A driver circuit for a matrix display device that includes a plurality of pixels disposed in rows and columns, the driver circuit comprising:

a first switch with a current path coupled between a reference voltage node and a group of pixels;

a second switch with a current path coupled between a high voltage node and the group of pixels, wherein the high voltage node is at a voltage greater than the reference voltage node;

a third switch with a current path coupled between an intermediate voltage node and the group of pixels, a voltage at the intermediate voltage node being between a voltage at the high voltage node and the voltage at the reference voltage node;

an inductive storage element with a current path coupled in series with the current path of the third switch, the inductive storage element coupled between the group of pixels and the intermediate voltage node;

a control circuit with outputs to control the conductivity of the first switch, the second switch and the third switch, the control circuit causing no more than one of the first switch, the second switch and the third switch to be conductive at a time;

an oscillation sensing circuitry coupled to the current path of the inductive storage element, the oscillation sensing circuit including at least one output coupled to the control circuit; and a fourth switch with a current path coupled between a fourth voltage node and the group of pixels, the fourth voltage node being held at a voltage which is less than the voltage at the reference node.

15. The circuit of claim 14 and further comprising:

a fifth switch coupled between the inductive element and a fifth voltage node with a voltage level between the voltage on the fourth voltage node and the reference voltage; and a sixth switch coupled between the inductive element and the intermediate voltage node.

16. The circuit of claim 15 wherein the control circuit further includes outputs to control the conductivity of the fourth switch, the fifth switch and sixth switch, the control circuit causing no more than one of the first switch, the second switch, the third switch and the fourth switch to be conductive at a time and causing no more than one of the fifth switch and the sixth switch to be conductive at a time when third switch is conductive.

17. The circuit of claim 14 and further comprising:

a fifth switch with a current path coupled between the inductive element and a fifth voltage node with a voltage level between the voltage on the fourth voltage node and the reference voltage; and a sixth switch with a current path coupled between the inductive element and the intermediate voltage node;

wherein the oscillation sensing circuit comprises first oscillation sensing circuitry coupled to the current path of the fifth switch, the first oscillation sensing circuit including an output coupled to the controller;

wherein second oscillation sensing circuitry is coupled to the current path of the sixth switch, the second oscillation sensing circuit including an output coupled to the controller; and wherein the control circuit further includes outputs to control the conductivity of the fourth switch, the fifth switch and sixth switch, the control circuit causing no more than one of the first switch, the second switch, the third switch and the fourth switch to be conductive at a time and causing no more than one of the fifth switch and the sixth switch to be conductive at a time when third switch is conductive.

18. The circuit of claim 14 and further comprising:

a fifth switch with a current path coupled between a second inductive storage element and the group of pixels, the second inductive storage element being coupled to a fifth voltage node which is held at a voltage between the voltage at the fourth voltage node and the voltage at the reference voltage node; and a second oscillation sensing circuitry coupled to the current path of the second inductive storage element, the oscillation sensing circuit including an output coupled to the controller;

wherein the control circuit further includes outputs coupled to control the conductivity of the fourth switch and the fifth switch, the control circuit causing no more than one of the first, the second, third, fourth and fifth switch to be conductive at a time.

19. The circuit of claim 14 wherein the group of pixels comprises a row of pixels.

20. The circuit of claim 14 wherein the group of pixels comprises at least one column of pixels.

21. A display device comprising:

a plurality of pixels disposed in rows and columns;

a column driver with a plurality of outputs, each column driver output coupled to a respective one of the columns;

a row driver with a plurality of outputs, each row driver output coupled to a respective one of the rows, the row driver including:

a first switch with a current path coupled between a reference voltage node and the row of pixels;

an inductive element coupled to a bias voltage node;

second switch with a current path coupled between the inductive element and the row of pixels;

a control circuit with outputs to control the conductivity of the first switch and the second switch so that the first switch and the second switch are not conductive at the same time; and an oscillation sensing circuit coupled to the current path of the inductive element, the oscillation sensing circuit including an output coupled to the control circuit, wherein the oscillation sensing circuit includes a comparator with first and second inputs coupled to points in the current path of the inductive storage element and an output coupled to the control circuit and wherein the comparator comprises an operational amplifier.

22. The device of claim 21 wherein the display device comprises an active matrix liquid crystal display.

23. The device of claim 21 wherein the display device comprises a passive matrix liquid crystal display.

24. A driver system for a liquid crystal display (LCD) that includes a plurality of pixels disposed as a matrix of column and row lines, the driver system for driving a group of pixels to a high voltage and a low voltage, the driver system comprising:

an inductive element having first and second terminals, the second terminal of the inductive element being coupled to the group of pixels for at least some period of time during operation and not being coupled to the group of pixels for a second period of time during operation;

first and second bias nodes, the first bias node having a voltage bias less than the high voltage and the second bias node having a voltage bias greater than the low voltage;

first switch coupled between the first bias node and the first terminal of the inductive element;

a second switch coupled between the second bias node and the first terminal of the inductive element;

a control circuit with outputs to control the conductivity of the first and second switches;

an oscillation sensing circuit coupled to a node in a current path of the inductive storage element, the oscillation sensing circuit including an output coupled to the control circuit;

a reference voltage node, a voltage at the reference voltage node being less than the high voltage and greater than the low voltage, wherein the voltage at the first bias node is about half way between the voltage at the reference voltage node and the high voltage, and wherein the voltage at the second bias node is about half way between the voltage at the reference voltage node and the low voltage;

a third switch with a current path coupled between the reference voltage node and the group of pixels;

a fourth switch with a current path coupled between a high voltage node held at the high voltage and the group of pixels; and a fifth switch with a current path coupled between a low voltage node held at the low and the group of pixels.

25. The system of claim 24 wherein each pixel in the group of pixels is coupled to one of the row lines.

26. The system of claim 24 wherein the oscillation sensing circuit includes a comparator.

27. The system of claim 24 and further comprising a reference voltage node, a voltage at the reference voltage node being less than the high voltage and greater than the low voltage, wherein the voltage at the first bias node is about half way between the voltage at the reference voltage node and the high voltage, and wherein the voltage at the second bias node is about half way between the voltage at the reference voltage node and the low voltage.

28. The system of claim 24 and further comprising a reference voltage node with a reference voltage, the reference voltage being less than the high voltage and greater than the low voltage, wherein the voltage at the first bias node is greater than the reference voltage by about one over the square root of two times the absolute value of the difference between the high voltage and the reference voltage, and wherein the voltage at the second bias node has a value less than the reference voltage by about one over the square root of two times the absolute value of the difference between the low voltage and the reference voltage.

29. A driver system for a liquid crystal display (LCD) that includes a plurality of pixels disposed as a matrix of column and row lines, the driver system for driving a group of pixels to a high voltage and a low voltage, the driver system comprising:

an inductive element having first and second terminals, the second terminal of the inductive element being coupled to the group of pixels for at least some period of time during operation and not being coupled to the group of pixels for a second period of time during operation, wherein said group of pixels comprises at least one column of pixels;

first and second bias nodes, the first bias node having a voltage bias less than the high voltage and the second bias node having a voltage bias greater than the low voltage;

a first switch coupled between the first bias node and the first terminal of the inductive element;

a second switch coupled between the second bias node and the first terminal of the inductive element;

a control circuit with outputs to control the conductivity of the first and second switches;

an oscillation sensing circuit coupled to a node in a current path of the inductive storage element, the oscillation sensing circuit including an output coupled to the control circuit;

a second inductive element having first and second terminals, the second terminal of the second inductive element being coupled to a row of the pixels for at least some period of time;

third and fourth bias nodes, the third bias node having a voltage bias less than a high row select voltage and the fourth bias node having a voltage bias greater than a low row select voltage;

a third switch coupled between the third bias node and the first terminal of the second inductive element; and a fourth switch coupled between the fourth bias node and the first terminal of the second inductive element.

30. A driver system for a liquid crystal display (LCD) that includes a plurality of pixels disposed as a matrix of column and row lines, the driver system for driving a group of pixels to a high voltage and a low voltage, the driver system comprising:

a first inductive element having first and second terminals, the first terminal coupled to a first bias node which is held at a voltage less than the high voltage;

a second inductive element having first and second terminals, the first terminal coupled to a second bias node which is held at a voltage greater than the low voltage;

a first switch coupled between the second terminal of the first inductive element and the group of pixels, wherein the group of pixels comprises a set of columns of pixels;

a second switch coupled between the second terminal of the second inductive element and the group of pixels;

a control circuit with outputs to control the conductivity of the first switch and the second switch, the control circuit causing no more than one of the first switch and the second switch to be conductive at a time;

a first oscillation sensing circuitry coupled to the current path of the first switch, the oscillation sensing circuit including an output coupled to a controller;

a second oscillation sensing circuitry coupled to the current path of the second switch, the oscillation sensing circuit including an output coupled to a controller;

a third inductive element having first and second terminals, the first terminal coupled to a high row voltage node which is held at a voltage that is less than a high row select voltage;

a fourth inductive element having first and second terminals, the first terminal coupled to a low row voltage node which is held at a voltage that is greater than a low row select voltage.

31. The system of claim 30 wherein each pixel in the group of pixels is coupled to one of the row lines.

32. The system of claim 30 wherein each pixel in the group of pixels is coupled to at least one of the column lines.

33. The system of claim 30 and further comprising:

a third oscillation sensing circuitry coupled to the current path of the third switch, the oscillation sensing circuit including an output coupled to a controller;

a fourth oscillation sensing circuitry coupled to the current path of the fourth switch, the oscillation sensing circuit including an output coupled to a controller;

wherein the control circuit includes outputs to control the conductivity of the third switch and the fourth switch, the control circuit causing no more than one of the third switch and the fourth switch to be conductive at a time.

34. A driver circuit for a matrix display device that includes a plurality of pixels disposed in rows and columns, the driver circuit comprising:

a first switch with a current path coupled between a reference voltage node and a group of pixels;

an inductive element coupled to a reference voltage node;

a second switch with a current path coupled between the inductive element and the group of pixels;

a control circuit with outputs to control the conductivity of the first switch and the second switch, the control circuit causing no more than one of the first switch and the second switch to be conductive at a time;

oscillation sensing circuitry coupled to the current path of the inductive element, the oscillation sensing circuit including an output coupled to the control circuit;

a third switch coupled between the group of pixels and a second reference voltage node; and a fourth switch coupled between the group of pixels and a third reference voltage node.

35. The circuit of claim 34 wherein the oscillation sensing circuitry includes a comparator.

36. The circuit of claim 34 and further comprising a second oscillation sensing circuitry coupled to the current path of the inductive element, the second oscillation sensing circuit including an output coupled to a controller.

37. The circuit of claim 34 wherein the oscillation sensing circuitry comprises:

a comparator with first and second inputs and an output, the output being coupled to the controller; and first input connected to current path of the second switch and second input connected to a voltage close to the reference voltage.

38. The circuit of claim 34 wherein the oscillation sensing circuit comprises:

a comparator with first and second inputs and an output, the output being coupled to the controller; and a resistive element coupled between the first and second inputs of the comparator, the resistive element having a current path coupled in series with the inductor and the group of pixels.

39. The circuit of claim 38 wherein the resistive element is separate from the second switch.

40. A method of driving a group of pixels in a matrix display device, the method comprising:

inductively coupling the group of pixels to an intermediate voltage level between a first voltage level and a second voltage level;

sensing that the group of pixels has substantially reached a local extreme voltage level relative to the intermediate voltage level by sensing the direction of current flow to the group of pixels; and decoupling the group of pixels from the intermediate voltage level when it is sensed that the direction of current flow has changed, wherein the group of pixels is kept in a high-impedance state after the decoupling.

41. The method of claim 40 wherein sensing is performed by using an oscillation sensing circuit to senses a current reversal in a current path of the group of pixels.

42. The method of claim 41 wherein the current reversal is sensed by detecting a change in voltage polarity across a resistor in series with the current path of the group of pixels.

43. The method of claim 40 and further comprising snapping the group of pixels to the first voltage level after the decoupling from the intermediate voltage level.

44. The method of claim 40 and further comprising keeping said group of pixels in a high-impedance state after the decoupling from the intermediate voltage level.

45. The method of claim 40 wherein the decoupling of the group of pixels is triggered by oscillation sensing circuitry detecting an even number of voltage extrema is reached by pixels relative to the intermediate voltage level.

46. A method of driving a group of pixels in a matrix display device, the method comprising:

dividing the group of pixels in first and second subgroups of pixels, wherein pixels belonging to the first subgroup have grey level voltage values of a first polarity with respect to a reference value and require a change in voltage level towards a second polarity and wherein pixels belonging to the second subgroup have grey level voltage values of a second polarity with respect to a reference voltage level and require a change in voltage level towards the first polarity;

inductively coupling the first subgroup of pixels to a reference voltage level by means of a first inductor;

inductively coupling a second subgroup of pixels to the said reference voltage level by means of a second inductor;

sensing the status of the oscillations emerging in a closed circuit with a first and second oscillation sensing circuitry;

decoupling the first group of pixels from the reference voltage level when the first oscillation sensing circuitry detects that the first group of pixels substantially reaches a local extreme voltage level relative to the reference voltage level wherein each pixel of the first subgroup of pixels is snapped to its respective grey level voltage after the decoupling from the inductive storage element; and decoupling the second group of pixels from the reference voltage level when the second oscillation sensing circuitry detects that the second group of pixels substantially reaches a local extreme voltage level relative to the reference voltage level.

47. The method as recited in claim 46, wherein the decoupling of the first and second subgroup of pixels is triggered by sensing a current reversal with respect to the reference voltage level in a first and second oscillation sensing circuit.

48. The method as recited in claim 46, wherein each pixel of the second subgroup of pixels is snapped to its respective grey level voltage after the decoupling from the inductive storage element.

49. The method as recited in claim 46, wherein the first and second inductors are mutually coupled, and wherein the first and second oscillation sensing circuitry comprises a common oscillation sensing circuitry provided in the common current path of the first and second inductors, and wherein the common oscillator sensing circuitry senses the status of a common oscillation, and wherein the first and second group of pixels are decoupled from the reference voltage when the common oscillation sensing circuitry detects that the first and second group of pixels substantially reach a local extreme voltage level relative to the reference voltage level.

50. A method of driving a group of pixels in a matrix display device, the method comprising:

dividing the group of pixels in first and second subgroups of pixels, wherein pixels belonging to the first subgroup have grey level voltage values of a first polarity with respect to a reference value and require a change in voltage level towards a second polarity and wherein pixels belonging to the second subgroup have grey level voltage values of a second polarity with respect to a reference voltage level and require a change in voltage level towards the first polarity;

inductively coupling the first subgroup of pixels to a reference voltage level by means of a first inductor;

inductively coupling a second subgroup of pixels to the said reference voltage level by means of a second inductor;

sensing the status of the oscillations emerging in a closed circuit with a first and second oscillation sensing circuitry;

decoupling the first group of pixels from the reference voltage level when the first oscillation sensing circuitry detects that the first group of pixels substantially reaches a local extreme voltage level relative to the reference voltage level wherein each pixel of the first subgroup of pixels is kept in a high-impedance state after the decoupling; and decoupling the second group of pixels from the reference voltage level when the second oscillation sensing circuitry detects that the second group of pixels substantially reaches a local extreme voltage level relative to the reference voltage level.

51. The method as recited in claim 50, wherein each pixel of the second subgroup of pixels is kept in a high-impedance state after the decoupling from the inductive storage element.

52. The method as recited in claim 50, wherein the decoupling of the first and second subgroup of pixels is triggered by sensing a current extremum with respect to the reference voltage level in a first and second oscillation sensing circuit.

53. The method as recited in claim 50, wherein the decoupling of the first and second subgroup of pixels is triggered by sensing a current reversal.

54. The method as recited in claim 50, wherein the first and second inductors are mutually coupled, and wherein the first and second oscillation sensing circuitry comprises a common oscillation sensing circuitry provided in the common current path of the first and second inductors, and wherein the common oscillator sensing circuitry senses the status of a common oscillation, and wherein the first and second group of pixels are decoupled from the reference voltage when the common oscillation sensing circuitry detects that the first and second group of pixels substantially reach a local extreme voltage level relative to the reference voltage level.

* * * * *